US008814533B2

(12) United States Patent
Exner et al.

(10) Patent No.: US 8,814,533 B2
(45) Date of Patent: Aug. 26, 2014

(54) FLOOD WATER REMOVAL SYSTEM

(76) Inventors: Mark Exner, Irvine, CA (US); Bill Exner, Mission Viejo, CA (US); Aaron S. Bingle, Costa Mesa, CA (US); Eric A. Bingle, Costa Mesa, CA (US); David Cody Sizemore, Loveland, CO (US)

( * ) Notice: Subject to any disclaimer, the term of this patent is extended or adjusted under 35 U.S.C. 154(b) by 0 days.

(21) Appl. No.: 13/033,527

(22) Filed: Feb. 23, 2011

(65) Prior Publication Data

US 2011/0142687 A1 Jun. 16, 2011

Related U.S. Application Data

(63) Continuation of application No. 11/837,438, filed on Aug. 10, 2007, now abandoned.

(60) Provisional application No. 60/837,451, filed on Aug. 11, 2006, provisional application No. 60/903,097, filed on Feb. 22, 2007.

(51) Int. Cl.
*F04B 23/08* (2006.01)
*F04D 9/00* (2006.01)

(52) U.S. Cl.
CPC ..... *F04D 9/006* (2013.01)
USPC ..... 417/199.2; 417/201; 417/313; 417/364

(58) Field of Classification Search
CPC ..... F04D 9/04; F04D 9/004; F04D 9/005; F04D 9/006
USPC ..... 417/68, 69, 85, 199.1, 199.2, 234, 417/423.5, 423.6, 201, 364, 313; 415/196
See application file for complete search history.

(56) References Cited

U.S. PATENT DOCUMENTS

| | | | | |
|---|---|---|---|---|
| 1,840,257 | A | 1/1932 | Saxe et al. | |
| 2,275,502 | A * | 3/1942 | Broadhurst | 417/80 |
| 3,867,070 | A | 2/1975 | Sloan | |
| 3,898,019 | A * | 8/1975 | Reznick et al. | 417/362 |
| 3,922,110 | A * | 11/1975 | Huse | 417/2 |
| 4,116,582 | A | 9/1978 | Sloan | |
| 4,316,725 | A | 2/1982 | Hovind et al. | |
| 4,443,997 | A * | 4/1984 | Namdari | 56/13.3 |

(Continued)

FOREIGN PATENT DOCUMENTS

WO WO 03/078844 9/2003

OTHER PUBLICATIONS

International Search Report and Written Opinion, mailed Apr. 29, 2008, in connection with International Application No. PCT/US2007/017816.

*Primary Examiner* — Charles Freay
(74) *Attorney, Agent, or Firm* — Knobbe Martens Olson & Bear, LLP

(57) ABSTRACT

Flood water removal systems including a motor, a vacuum generating device, a discharge pump, and a vacuum tank can be efficiently arranged to be transversely mounted to a vehicle. Certain flood water removal systems can include a supercharger driven by the engine to generate vacuum. The systems can include a valve to prevent collapse of a vacuum tank and maintain a predetermined vacuum pressure without varying the speed of the motor. The systems can also include a two-stage exhaust that blends exhaust from the blower with motor exhaust in a silencer to reduce noise generation for operation in residential or other noise-sensitive settings. The systems can also include a vacuum tank comprising a noise reduction baffle to further reduce noise generation.

31 Claims, 40 Drawing Sheets

(56) References Cited

U.S. PATENT DOCUMENTS

| | | | | | |
|---|---|---|---|---|---|
| 4,479,763 | A | * | 10/1984 | Sakamaki et al. | 418/144 |
| 4,659,347 | A | | 4/1987 | Schrems | |
| 4,681,508 | A | | 7/1987 | Kim | |
| 4,995,347 | A | * | 2/1991 | Tate et al. | 123/65 BA |
| 4,997,464 | A | | 3/1991 | Kopf | |
| 5,118,262 | A | * | 6/1992 | Kuo | 417/363 |
| 5,219,271 | A | | 6/1993 | Nachtrieb | |
| 5,244,365 | A | * | 9/1993 | Catcher | 417/569 |
| 5,558,502 | A | | 9/1996 | Fukazawa et al. | |
| 5,664,935 | A | | 9/1997 | Nishiuchi et al. | |
| 5,902,971 | A | * | 5/1999 | Sato et al. | 181/262 |
| 6,119,304 | A | | 9/2000 | Berfield et al. | |
| 6,592,340 | B1 | * | 7/2003 | Horo et al. | 417/293 |
| 6,629,821 | B1 | | 10/2003 | Yokota et al. | |
| 6,692,234 | B2 | * | 2/2004 | Muhs | 417/199.2 |
| 6,742,612 | B2 | * | 6/2004 | Campbell et al. | 180/6.48 |
| 6,936,085 | B2 | * | 8/2005 | DeMarco | 55/324 |
| 6,997,972 | B2 | | 2/2006 | Tseng | |
| 7,794,211 | B2 | * | 9/2010 | Muhs | 417/69 |
| 2002/0114707 | A1 | * | 8/2002 | Carnes et al. | 417/200 |
| 2002/0122727 | A1 | * | 9/2002 | Gaither | 417/16 |
| 2005/0284872 | A1 | | 12/2005 | Gombert et al. | |
| 2005/0287029 | A1 | * | 12/2005 | Chung et al. | 418/206.5 |
| 2006/0153702 | A1 | * | 7/2006 | Britton | 417/364 |
| 2006/0275146 | A1 | * | 12/2006 | Williams | 417/234 |

* cited by examiner

FLOOD WATER REMOVAL SYSTEM

CROSS-REFERENCE TO RELATED APPLICATIONS

This application is a continuation of U.S. patent application Ser. No. 11/837,438, filed on Aug. 10, 2007, which claims the benefit of U.S. Provisional Patent Application No. 60/837,451, filed on Aug. 11, 2006, entitled "FLOOD WATER REMOVAL SYSTEM" and U.S. Provisional Patent Application No. 60/903,097, filed on Feb. 22, 2007, entitled "FLOOD WATER REMOVAL SYSTEM", the entireties of all of which are hereby incorporated by reference.

BACKGROUND OF THE INVENTION

1. Field of the Invention

This application relates specifically to devices for removing flood water and more specifically to compact, vehicle mounted devices for removing flood water.

2. Description of the Related Art

Property damage due to weather-related flooding in the United States is on the order of billions of dollars annually. Non weather-related flooding (such as can be caused by plumbing and water main leaks and failures) further escalates the amount of property damage caused by flood water annually. In the face of catastrophic weather events, a certain amount of flood water damage is inevitable. However, the damage due to flood water can be mitigated by rapid removal of the flood water from residential and commercial building. Rapid removal of flood water can reduce the risk of water damage to residential construction and can reduce the risk of subsequent mold growth.

Various devices for removing flood water are known in the art. However, flood water removal devices known in the art suffer from significant shortcomings. Often, vehicle-mounted carpet cleaning systems are used for flood water removal. These systems often include electric motors that drive vacuum pumps for creating vacuum in a hose or pipe to remove water from a flooded location. Powering the electric motors can prove problematic in flood damaged areas, where power grids are often inoperative for days or (in the instance of a major hurricane) weeks following a large scale flood event. Thus, the transport vehicle's engine must often be used to provide power for these systems. They can typically transport water at flow rates of approximately 5 gallons per minute, often requiring long periods for flood water removal.

Additionally, some previous water removal systems include internal combustion engines that are relatively large and noisy. These previous systems have often utilized substantially all of the cargo space of the vehicles on which they were mounted, leaving little room for other tools and equipment. Moreover, these systems have typically generated noise levels in excess of 100 decibels. This high level of noise generation often precluded the use of such devices during many hours of the day in residential areas.

SUMMARY OF THE INVENTION

In various embodiments discussed in more detail below, a liquid removal system is disclosed herein that overcomes at least some of the shortcomings of the previous systems noted above. The liquid removal systems disclosed herein can be arranged as a compact, stand-alone unit that can be easily mounted in a vehicle or on a trailer. In certain embodiments, the liquid removal system can include features to reduce noise generation to acceptable levels for use in residential areas regardless of the time of day. In certain embodiments, the liquid removal system can also include a vacuum tank pressure relief system that allows the motor to run at a constant speed, thus reducing costs and noise variations.

In accordance with an aspect of the invention, a system for transporting liquid is provided. The system comprises a motor, a suction generation device, and a discharge pump. The motor has an output shaft. The output shaft defines a longitudinal axis of the system. The suction generation device is positioned longitudinally behind the motor and laterally offset from the motor relative to the longitudinal axis of the system. The suction generation device is coupled to the motor such that operation of the motor drives the suction generation device. The discharge pump is positioned longitudinally behind the motor and laterally offset from the motor relative to the longitudinal axis in a direction opposite the lateral offset of the blower. The pump is coupled to the motor such that operation of the motor drives the pump. The motor, the suction generation device, and the discharge pump are positioned such that the system is configured to fit inside a vehicle oriented such that the longitudinal axis is substantially aligned with a width of the vehicle.

Another aspect of the invention includes a system for transporting liquid that comprises an internal combustion engine, a liquid intake port, a liquid outlet port, a supercharger, and a discharge pump. The internal combustion engine has an output shaft. The supercharger has an input shaft driven by the output shaft of the internal combustion engine, the input shaft coupled to a compressor. The compressor is configured to create vacuum in the liquid intake port. The liquid intake port communicates with the outlet port. The discharge pump is coupled to the output shaft of the motor such that operation of the motor drives the pump. The pump is configured to transport liquid out of the liquid outlet port.

Another aspect of the invention includes a vacuum tank for a liquid transport system that comprises a first tank portion, a second tank portion configured to be coupled to the first tank portion, a liquid discharge port, and a baffle. The first tank portion has a liquid intake port therethrough. The second tank portion has a vacuum port therethrough. The liquid discharge port is disposed in one of the first tank portion and the second tank portion. The baffle is interposed between the first and second tank portions and configured such that gas flow between the liquid intake port and the vacuum port is redirected therethrough.

Another aspect of the invention includes a system for transporting liquid that comprises an internal combustion engine, a vacuum generator, a discharge pump, and an exhaust system. The internal combustion engine has an intake system and an exhaust outlet. The vacuum generator is coupled to the engine such that operation of the engine drives the vacuum generator. The vacuum generator has a suction port and an exhaust port. The discharge pump is coupled to the engine such that operation of the engine drives the pump. The exhaust system directs a flow of exhaust gases from the exhaust outlet of the engine. The exhaust system comprises a muffler. The muffler is fluidly coupled to the exhaust outlet of the engine and is configured to receive the flow of exhaust gases from the engine.

The systems and methods of the invention have several features, no single one of which is solely responsible for its desirable attributes. Without limiting the scope of the invention as expressed by the claims, its more prominent features have been discussed briefly above. After considering this discussion, and particularly after reading the section entitled "Detailed Description of the Preferred Embodiments," one will understand how the features of the system and methods provide several advantages over conventional liquid removal systems.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The following are brief descriptions of the drawings.

DETAILED DESCRIPTION OF THE PREFERRED EMBODIMENT

Figure 1:
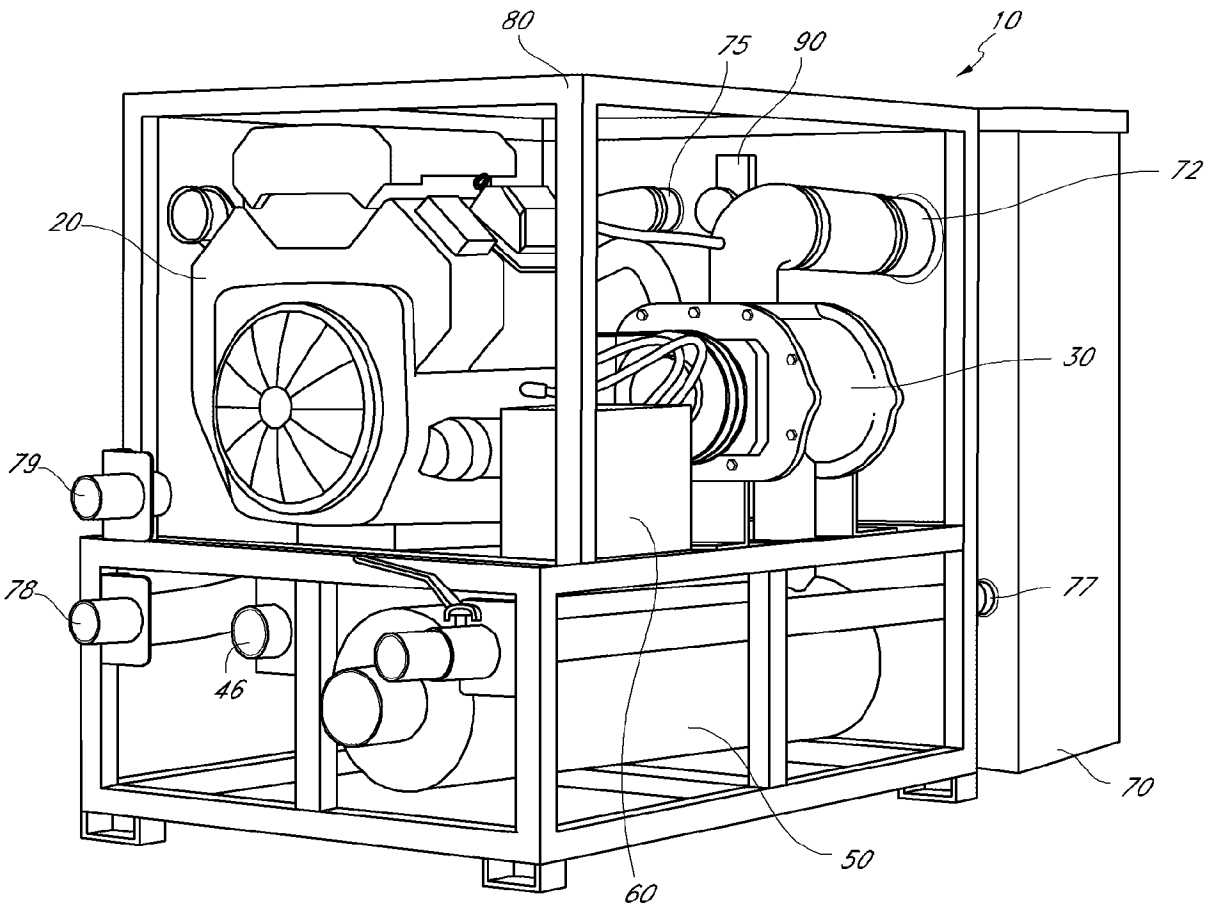
FIG. 1 is a front side perspective view of liquid removal system configured in accordance with one embodiment of the invention.
Figure 2:
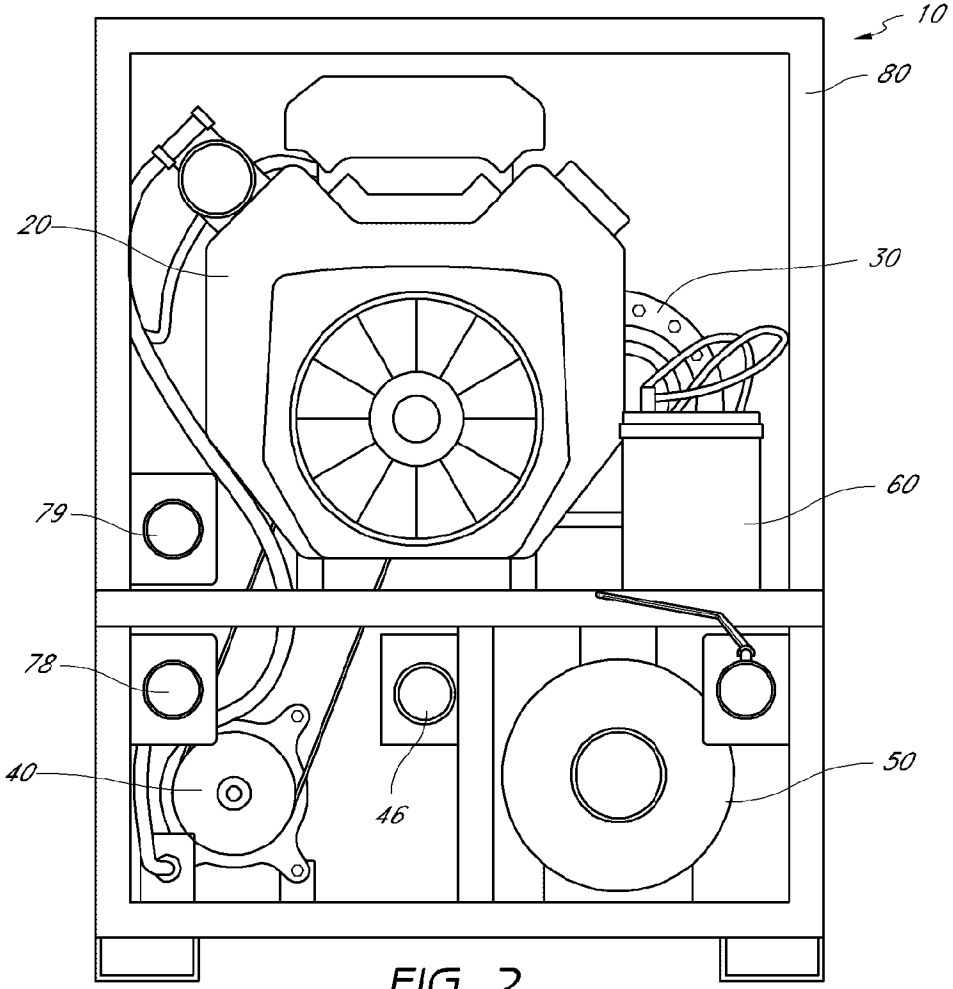
FIG. 2 is a front view of the liquid removal system of FIG. 1.

In various embodiments, a liquid removal system is disclosed herein that overcomes the above-described shortcomings of the prior art. As discussed in more detail below, in various embodiments the liquid removal system can be compact to facilitate vehicle mounting, can generate low noise for ease of use in noise-sensitive environments, and can provide relatively high liquid removal rates. A vehicle-mounted flood water removal device can provide a rapid response to flood water in an attempt to reduce the incidence and amount of property damage. In still other embodiments, a vacuum tank for a liquid removal system is disclosed that is configured to reduce noise generation of a liquid removal system. In still other embodiments, a pressure regulation system for a vacuum tank is disclosed that does not require complex engine speed controls. Not all embodiments need to include all of the above-noted features.

With reference to FIGS. 1-4, an embodiment of liquid removal system 10 is illustrated. The liquid removal system 10 comprises a motor 20, a blower 30 operatively coupled to the motor, and a discharge pump 40. In the illustrated embodiment, the liquid removal system 10 also comprises a silencer 50, a sealed gel battery 60, and a vacuum tank 70. The components of the liquid removal system 10 can be mounted on a support frame 80.

In the illustrated embodiment of FIGS. 1-4, the motor 20 is a four stroke, spark ignition air-cooled internal combustion reciprocating piston engine, such as is commercially available under the Kohler® Command Pro or Honda lines of engines. It is contemplated that in other embodiments, other motor 20 types and configurations can be used in the liquid removal system. For example, in other embodiments, the motor 20 can be a liquid cooled internal combustion engine, rotary internal combustion engine, two-stroke internal combustion engine, compression ignition internal combustion engine, gas turbine engine, or electric motor.

In the illustrated embodiment, the motor 20, an internal combustion engine, requires a supply of fuel such as gasoline to operate. Thus the liquid removal system 10 can include a fuel tank in fluid connection to a fuel system on the motor 20. In other embodiments, the liquid removal system can further include a fuel input port configured to receive fuel from an external fuel tank such as a portable fuel can or the fuel tank of a vehicle to which the liquid removal system 10 is mounted. In some embodiments, this fuel input port can be positioned on the fuel tank of the liquid removal system 10, and in other embodiments, the fuel input port can be integrated with the fuel system of the motor 20. Furthermore, it is contemplated that in some embodiments, the liquid removal system 10 does not have a dedicated fuel tank, but instead the liquid removal system 10 receives a fuel supply from an external fuel tank such as can be connected to the fuel input port. Advantageously, the fuel input port allows flexible sourcing of fuel so that the liquid removal system 10 can be run for extended periods of time without being limited to a single source of fuel.

Figure 4:
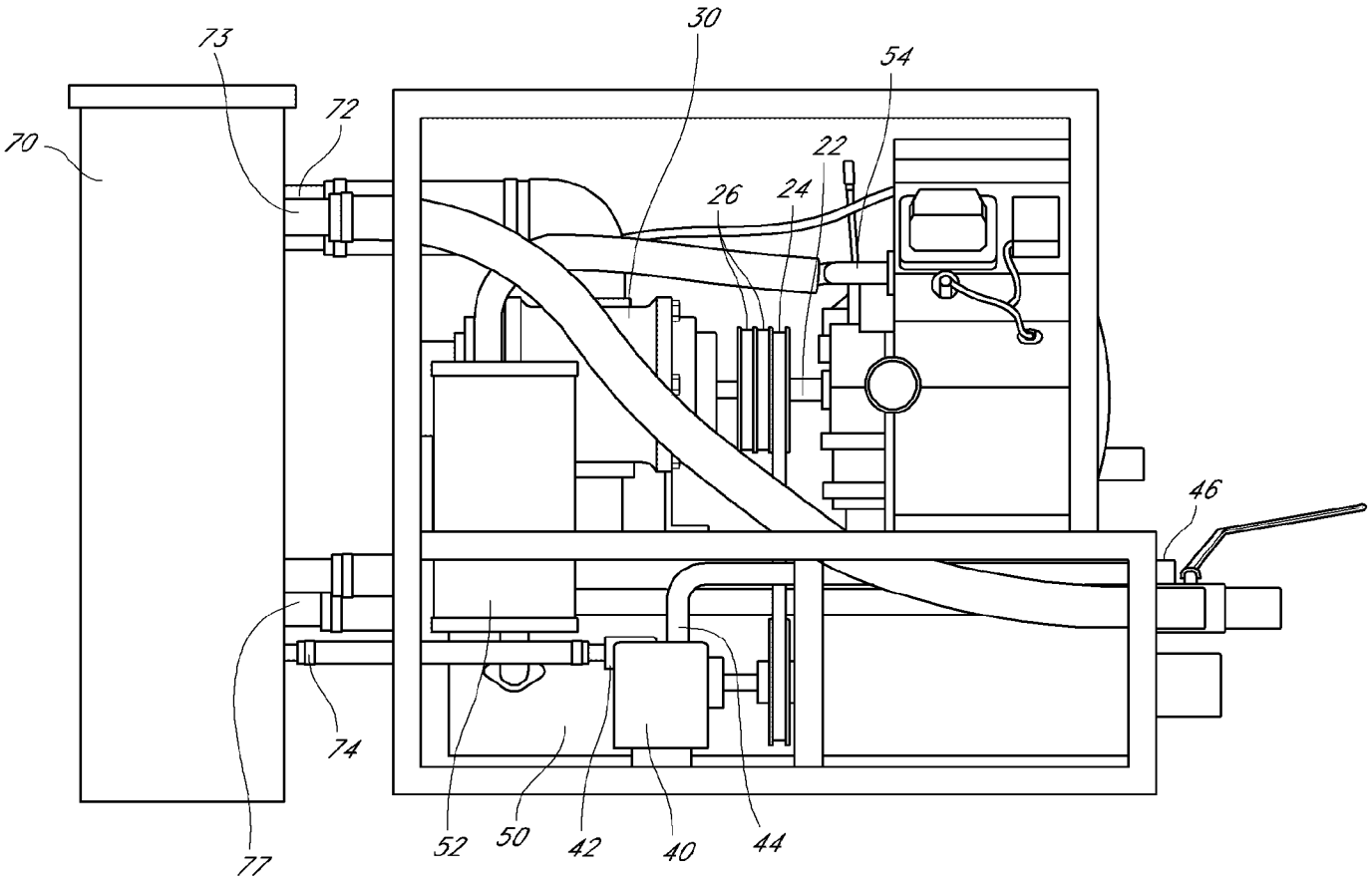
FIG. 4 is a left side view of the liquid removal system of FIG. 1.

With reference to FIG. 4, the motor 20 has an output shaft 22 that rotates when the motor 20 is in operation. A longitudinal axis of the output shaft 22 defines a longitudinal axis of the system about which various other components can be arranged to achieve a compact system package. The output shaft 20 can have at least one pulley 24 mounted thereon over which a corresponding at least one drive belt 26 can be routed to drive the blower 30 and the discharge pump 40 as discussed further below. In other embodiments, the blower 30 and the discharge pump 40 can be driven by the motor 20 through a geared transmission, a chain drive or other drive mechanisms.

Figure 3:
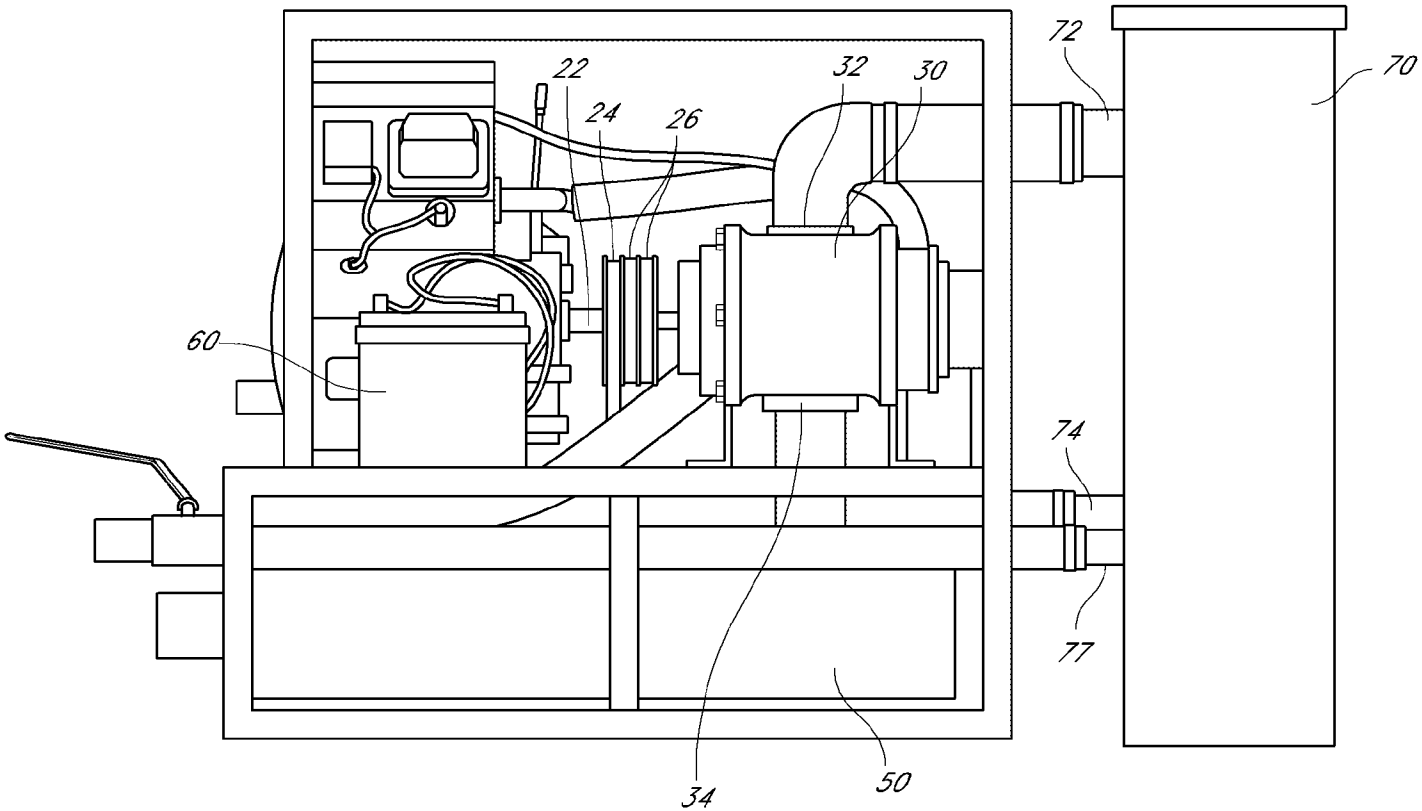
FIG. 3 is a right side view of the liquid removal system of FIG. 1.

The blower 30 can be a roots-type blower configured to be driven by the motor 20. It is contemplated that other blower types can be used in other embodiments of liquid removal system 10. With reference to FIG. 3, the blower has a suction port 32 at which a vacuum pressure is generated and an exhaust port 34 through which an outgoing gas stream (e.g. an air stream) is passed when the blower 30 is in operation. In the illustrated embodiment, the suction port 32 of the blower is fluidly coupled to the vacuum tank 70 to generate a vacuum pressure in the vacuum tank 70 when the blower 30 is operating. The exhaust port 34 of the blower 30 is fluidly coupled to the silencer 50 to reduce noise generation of the liquid removal system 10 as further discussed below. The blower 30 desirably generates sufficient vacuum in the vacuum tank 70 to transport at least approximately 30 gallons per minute of liquid into the vacuum tank 70 through a 1½" diameter hose, although this rate is only an example. In other embodiments, the blower 30 desirably generates sufficient vacuum in the vacuum tank 70 to transport at least approximately 60 gallons per minute of liquid into the vacuum tank 70 through a 1½" diameter hose.

While the liquid removal system 10 embodied in FIGS. 1-4 includes a blower 30 driven by the motor 20 to generate vacuum, it is contemplated that in other embodiments, a turbocharger or a supercharger can be used to generate vacuum. In embodiments having a turbocharger, the turbocharger can have a gas turbine coupled to a compressor. The gas turbine can be fluidly coupled to an exhaust system of the motor 20 such that the exhaust gas stream from the motor 20 drives the turbine, which in turn drives the compressor. A suction port on the compressor, at which vacuum pressure is generated, can be fluidly coupled to a vacuum tank to generate vacuum in the tank. In embodiments of liquid removal system having a supercharger to generate vacuum, the supercharger can be a centrifugal supercharger having a compressor driven by a belt, chain, gear, or other operative drive connection from the output shaft of the motor 20. The compressor of the supercharger generates vacuum much in the same way described above with respect to the turbocharger. The supercharger can be fluidly coupled to a vacuum tank to generate vacuum pressure in the vacuum tank. In still other embodiments, other supercharger types can be used such as, for example, twin screw superchargers.

Embodiments of liquid removal systems incorporating turbocharger or centrifugal supercharger to generate vacuum can have certain advantages over those using roots-type blowers from the standpoints of size, weight, and noise generated. Turbochargers and centrifugal superchargers typically occupy significantly less space than a roots-type blower for a similar vacuum pressure generation capability. Correspondingly, turbochargers and centrifugal superchargers typically weigh less than corresponding roots-type blowers. Additionally, whereas roots-type blowers tend to generate high levels of noise and sometimes uncomfortable low-frequency compression waves, turbochargers and centrifugal superchargers tend to generate fairly low-noise high-pitched whines in operation. Furthermore, the expansion of engine exhaust gases over the turbine in the turbocharger can reduce the noise generated by the engine in a liquid removal system.

With reference to FIG. 4, the discharge pump 40 can be a liquid transportation pump. Various pumps suitable for this purpose are commercially available from the Dayton Electric Mfg. Co. The pump 40 has a liquid intake port 42 and a liquid discharge port 44. The liquid intake port 42 can be fluidly coupled to a liquid discharge port 74 of the vacuum tank 70. The liquid discharge port 44 can be fluidly coupled to a liquid outlet port 46 of the liquid removal system 10. The liquid discharge pump 40 desirably operates at a relatively high flow rate. In certain embodiments, the discharge pump has a flow rate of at least 30 gallons per minute through a 1½" diameter discharge hose. In other embodiments, the discharge pump has a flow rate of at least 60 gallons per minute through a 1½" diameter discharge hose. In other embodiments, the discharge pump has a flow rate of at least 100, and in some embodiments up to 140 gallons per minute through a 1½" diameter discharge hose.

With reference to FIGS. 1-4, the silencer 50 greatly reduces the audible noise output of the liquid removal system 10 as compared to previous water removal systems. In the illustrated embodiment, the motor 20 includes an exhaust system. The exhaust system comprises a muffler 52 (FIG. 4) that is fluidly coupled to one or more exhaust ports 54 on the motor 20. The muffler 52 has a resonance chamber that allows the exhaust gas flow to expand thus, reducing noise energy levels of the exhaust flow. The muffler 52 is fluidly coupled, at its downstream end to the silencer 50. Thus, the silencer 50 provides a second stage of noise reduction for the exhaust gas flow. As noted above, the exhaust port 34 of the blower is also fluidly coupled to the silencer 50. Thus, in the silencer 50, the partially expanded exhaust gases from the muffler 52 are mixed with a flow of much cooler air from the exhaust port 34 of the blower. In the illustrated embodiment, the silencer 50 comprises a generally cylindrical relatively large diameter resonance chamber, enhancing mixture of, and promoting expansion of the gases. With the two stage noise reduction exhaust, the illustrated liquid removal system 10 can generate noise levels of less than 80 decibels in operation. Thus, advantageously, the liquid removal system 10 can be operated in residential neighborhoods and other noise-sensitive areas. Certain embodiments of liquid removal system 10 including a turbocharger or a supercharger instead of a roots-type blower can operate at reduced noise levels without a silencer 50, thus some embodiments of these systems may not have a silencer.

With reference to FIG. 1, the liquid removal system 10 can include a sealed gel battery 60. This battery 60 allows maintenance free operation of the pump system and allows the motor 20 to be started and run without connection to a vehicle's power system.

With reference to FIGS. 1-4 the liquid removal system 10 can include a vacuum tank 70. In the illustrated embodiment, the vacuum tank 70 can include a vacuum port 72 to which a suction side of the blower 30 is fluidly coupled. Operation of the blower 30 on the vacuum port 72 creates vacuum in the vacuum tank 70. The vacuum tank 70 is desirably configured to withstand vacuum generated therein to allow the liquid removal system to remove approximately 30 gallons of liquid per minute from a flooded area. In other embodiments, the vacuum tank 70 is desirably configured to withstand vacuum generated therein to allow the liquid removal system to remove at least approximately 60 gallons of liquid per minute from a flooded area.

The vacuum tank 70 can also include a liquid intake port 73. The liquid intake port 73 can be fluidly coupled to a suction fitting 78 to which a vacuum hose can be joined. In some embodiments, the liquid intake port 73 can be fluidly coupled to a second suction fitting 79 (shown as disconnected in FIG. 1), thus allowing two vacuum hoses to be coupled to the system 10 for more rapid liquid removal, or for liquid removal from multiple rooms or locations simultaneously.

The vacuum tank 70 can also include a liquid discharge port 74. In the illustrated embodiment, the liquid discharge port 74 is fluidly coupled to the discharge pump 40 as described above. As described above, the discharge pump 40 can be fluidly coupled to a liquid discharge outlet 46 to which a discharge hose or other device can be coupled. In certain embodiments, the discharge hose can be of lay flat construction.

In some embodiments, the vacuum tank 70 can include a drain port 77. The drain port 77 is desirably positioned on a relatively low point on the vacuum tank 70. The drain port 77 is desirably selectively controllable, such as with a valve, between an open state in which liquid can exit the vacuum tank 70 through the drain port 70 and a closed state in which liquid is substantially prevented from exiting the vacuum tank 70 through the drain port 77. While the drain port 77 is depicted in FIGS. 1-4 as a port distinct from and in addition to the liquid discharge port 74, in other embodiments it is contemplated that the liquid discharge port 74 and the drain port 77 can be combined in a single port such as, for example, with the addition of a bypass of the discharge pump 40 when it is desired to drain the vacuum tank under gravity liquid feed.

With reference to FIG. 1, in certain embodiments the system 10 can also include a pressure relief system to guard against collapse of the vacuum tank 70. As illustrated, the pressure relief system comprises a valve 90 fluidly coupled to the vacuum tank 70. The valve 90 has an open state in which ambient air is allowed into the vacuum tank 70 through the valve 90 and a closed state in which ambient air is substantially prevented from entering the vacuum tank 70 through the valve 90. The valve 90 can be configured to enter the open state when the vacuum generated inside the tank 70 approaches a collapse pressure of the vacuum tank 70. In some embodiments, the valve 90 can be a demand valve that is configured to open when a preselected vacuum is achieved in the vacuum tank 70. In other embodiments, the pressure relief system 90 can also include a sensor configured to monitor the vacuum generated inside the vacuum tank 70 and a processor operatively coupled to the sensor and the valve and configured to open the valve when the sensor detects a vacuum approaching the collapse vacuum of the vacuum tank 70. Advantageously, the pressure relief system allows the motor 20 to be run at a constant speed with a low risk of vacuum tank 70 collapse. In contrast, previous tank collapse monitoring systems have required complex processors to monitor and control the motor speed to prevent excess vacuum generation in the vacuum tank. These systems were complex and costly to acquire and maintain.

In the embodiments illustrated in FIGS. 1-4, the vacuum tank 70 is shaped as a generally rectangular prism. A rectangular prismatic vacuum tank 70 can be formed for example by welding sheets of metal together to form a rectangular prism. In some embodiments, sheets of metal can be bent prior to welding to form more than one side of the prism. In some embodiments, the rectangular prism can have a removable panel, such as a top panel. Such a shape can be advantageous for fitting the system 10 in certain spaces such as the interior of a vehicle. It is contemplated that in other embodiments, including those illustrated in FIGS. 7-13, the vacuum tank 70 can have more rounded features including sections that are substantially cylindrical or spherical and edges that are radiused. It is contemplated that a pressure vessel such as a vacuum tank 70 with rounded features can withstand higher pressure loadings than a corresponding pressure vessel with angular features. Moreover, such a rounded vacuum tank can be formed of non-metallic components by rotomolding or other operations. Thus, in a vacuum tank 70 with rounded features, there may be a reduced need for a pressure relief system and valve as described above.

With reference to FIG. 1, the system 10 includes a support frame 80 to which the motor 20, the blower 30, the discharge pump 40, the silencer 50, the sealed gel battery 60, and the vacuum tank 70 are mounted. In other embodiments, some of these components may not be mounted to the support frame 80. The support frame 80 is illustrated as a generally rectangular prism comprised of several smaller rectangular prisms constructed of generally square cross-section tubing sections. The square tubes are formed of a metal material such as steel, aluminum, or alloys thereof, although it is contemplated that in other embodiments, different materials including wood, composite materials, or plastics could form a portion of, or substantially all of the support frame 80. In some embodiments, the frame 80 can include open rectangular skids forming feet thereof. The skids can be sized and configured to allow the frame 80 to be picked up and moved via forklift. Additionally, it is contemplated that in other embodiments, the support frame 80 can include different geometry such as one including triangular truss members. Desirably, the support frame is sized and configured to fit transversely within a vehicle such as a truck, van, or minivan and provide access to the suction fitting 78 and liquid outlet port 46. In some embodiments, the support frame has a relatively long dimension configured to be arranged transversely in a vehicle and a relatively short dimension configured to be arranged longitudinally in a vehicle. In one exemplary embodiment, the support frame defines a rectangular prism approximately 33" long by 26" wide by 30" tall. In this exemplary embodiment, it is desired to orient the frame for mounting in a vehicle such that the 33" length dimension of the liquid removal system is positioned along a width of the vehicle. Thus, the system 10 can be positioned in a vehicle such that it occupies substantially all of a width of the vehicle but leaves a portion of the length of the vehicle open for cargo. Advantageously, this transverse positioning in a vehicle allows much greater cargo space than would be available if the system 10 were longitudinally mounted.

In the illustrated embodiment, the support frame 80 is configured to package components of the system 10 to facilitate transverse mounting on a vehicle. The output shaft 22 of the motor 20 defines a longitudinal axis of the system 10. The blower 30 can be mounted distally of the motor 20 along the longitudinal axis and offset transversely from the longitudinal axis of the system. The discharge pump 40 can be mounted distally of the motor 20 along the longitudinal axis and offset transversely from the longitudinal axis of the system in a direction generally opposite of the transverse offset of the blower 30. The vacuum tank 70 can be mounted distally of the blower 30 and the discharge pump 40 in a direction along the longitudinal axis. The silencer 50, and the fluid connections to the suction fitting 78 and the liquid outlet port 46 can be routed generally parallel to the longitudinal axis in a plane that is vertically offset from the longitudinal axis.

Figure 5:
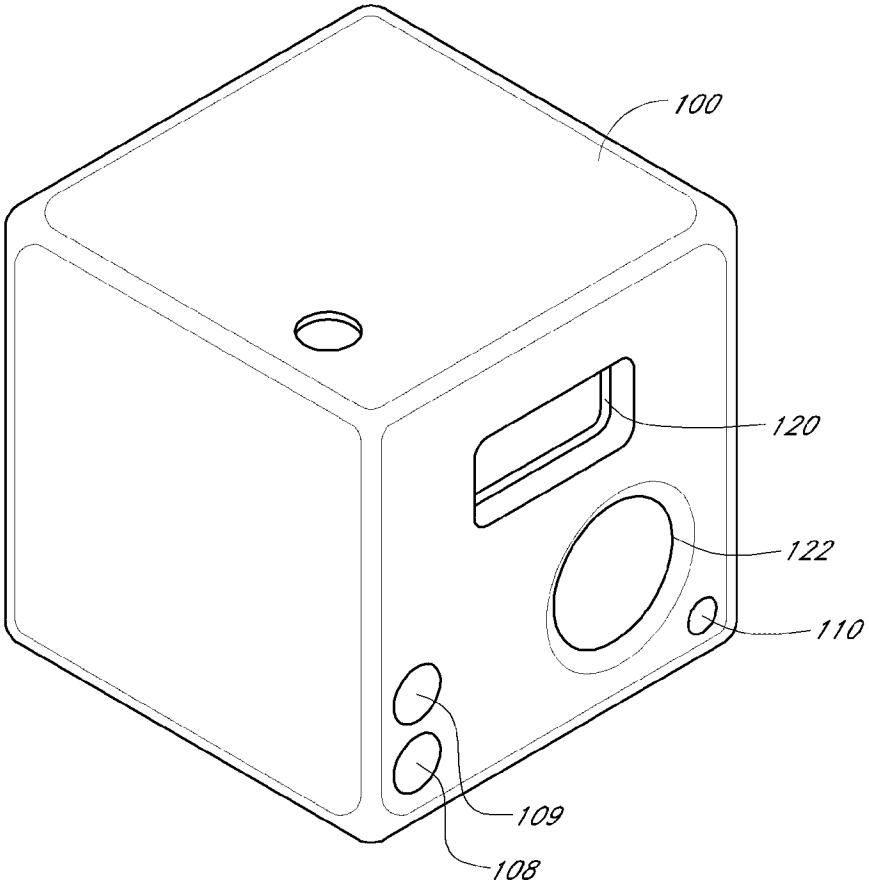
FIG. 5 is a perspective view of one embodiment of housing for a liquid removal system.

With reference to FIG. 5, in some embodiments, the system 10 can include a housing 100 configured to be disposed over the support frame 80. The housing 100 can include apertures such as a suction fitting aperture 108 for access to the suction fitting 78, a second suction fitting aperture 109 for access to the second suction fitting 79, a motor aperture 120 for access to controls on the motor 20, a drain aperture 110 for access to the drain port 77 and other similar apertures. In different embodiments of housing, the positions and sizes of these apertures can differ. In some embodiments, the housing can have an open front side configured to receive a removable front panel, such as that illustrated in FIG. 37 below including some or all of the various apertures described above.

Figure 6:
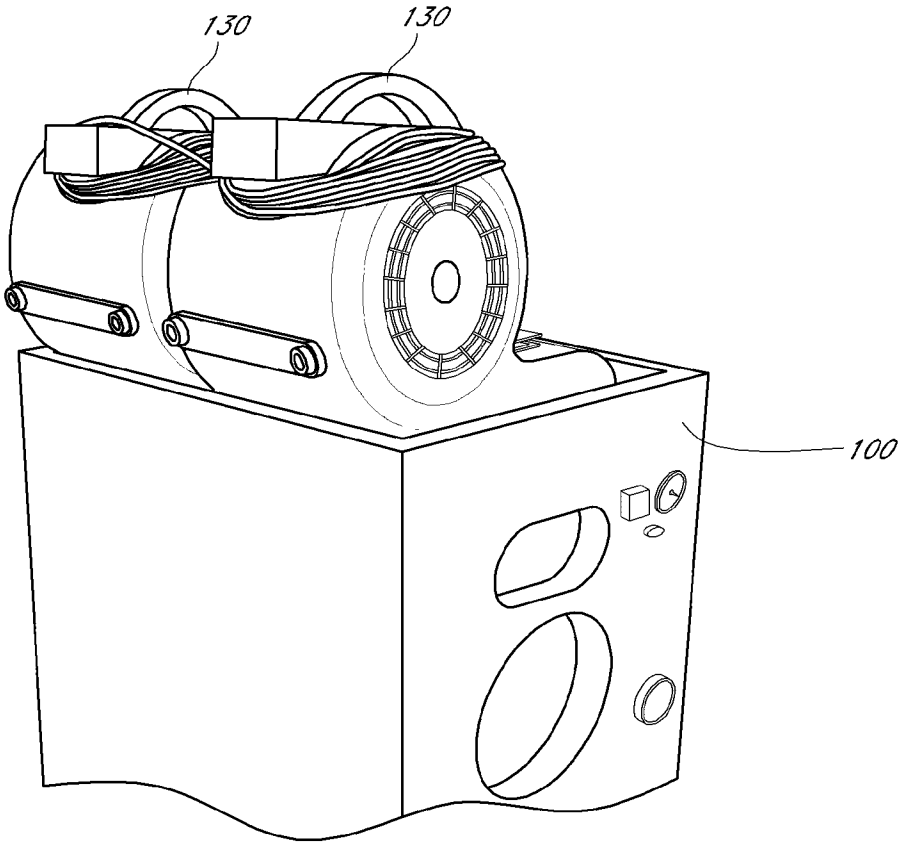
FIG. 6 is a perspective view of another embodiment of housing for a liquid removal system including an upper storage surface.
Figure 7:
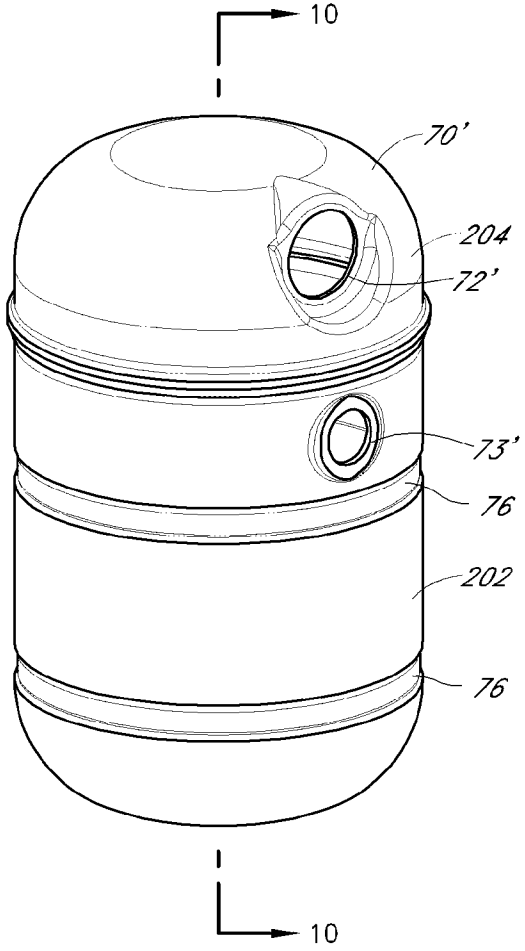
FIG. 7 is a perspective view of one embodiment of vacuum tank for use in a liquid removal system.
Figure 8:
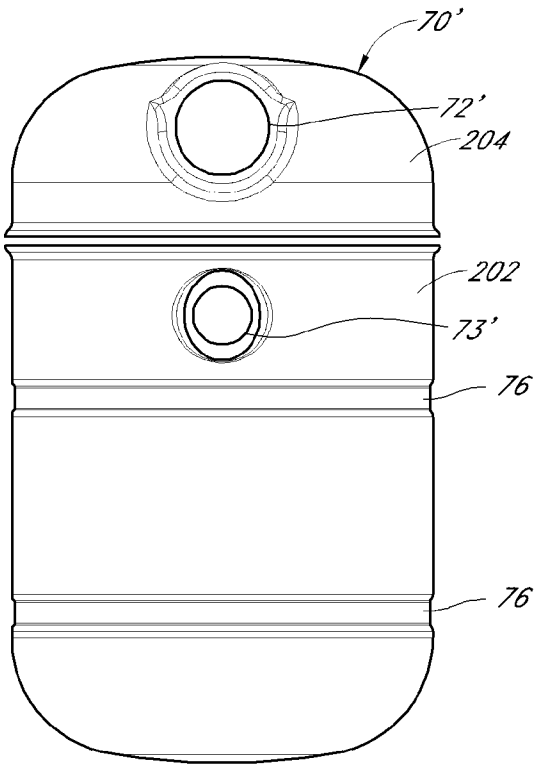
FIG. 8 is a front view of the vacuum tank of FIG. 7.
Figure 9:
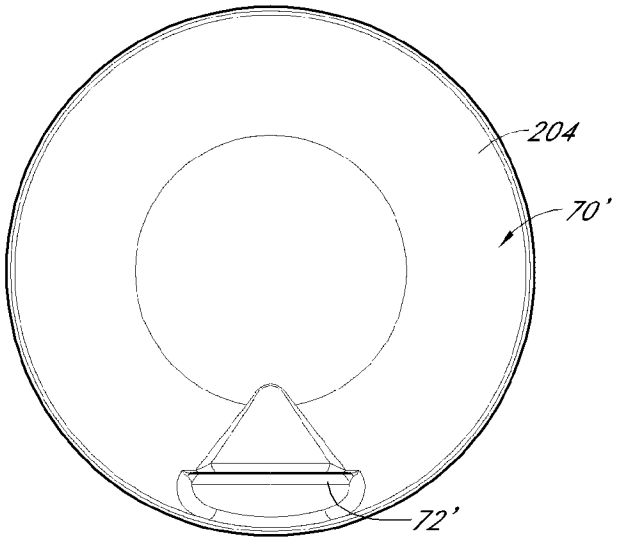
FIG. 9 is a top view of the vacuum tank of FIG. 7.
Figure 10:
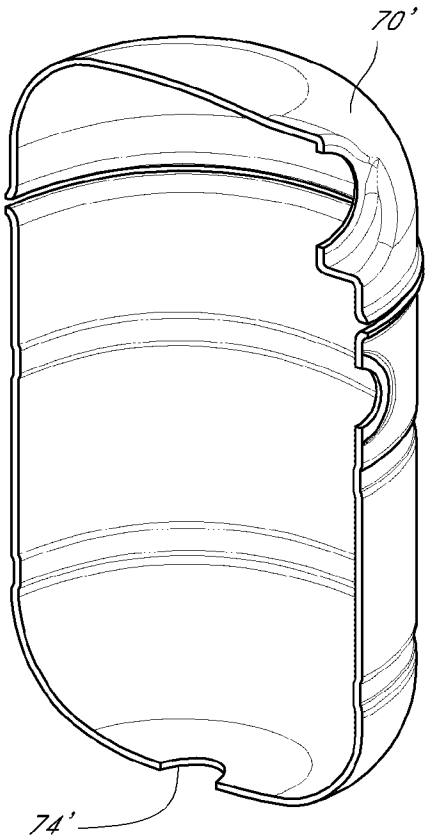
FIG. 10 is a cross-sectional view of the vacuum tank of FIG. 7 taken about section line 10-10.

In some embodiments, such as those illustrated in FIG. 6, the housing 100 can have a contoured surface configured to receive tools and equipment commonly used in liquid removal. For example, in certain embodiments, an upper surface of the housing 100 includes indentations shaped and configured to receive large carpet drying machines 130 such as those commonly in use in the carpet cleaning industry. In other embodiments, as illustrated in FIG. 6, the upper surface of the housing can be configured, for example by providing a notched outer lip spanning a perimeter of the upper surface to retain hose reels for vacuum and/or discharge hoses to be used in conjunction with the liquid removal system 10. The upper surface of the housing 100 can be structurally reinforced to support the weight of these carpet drying machines 130 or other equipment. Advantageously, this contouring can enhance the storage ability of a vehicle transporting the liquid removal system 10.

With reference to FIGS. 7-10, another embodiment of vacuum tank 70' is depicted. In the embodiment illustrated in FIGS. 7-10, the vacuum tank 70' has a generally rounded body. As noted above, this rounded shape can have a higher ability to withstand vacuum loading, and thus can have a relatively high collapse strength. The vacuum tank 70' can include one or more annular reinforcing rings 76 to further enhance its ability to withstand vacuum loading. A rounded vacuum tank 70' can be formed via rotomolding to the desired geometry.

As illustrated, the vacuum tank 70' has a first tank portion 202 having a liquid intake port 73' and a second tank portion 204 having a vacuum port 72'. In the illustrated embodiments, the two tank portions can be coupled by ring lock compression bands to form the vacuum tank 70'. The liquid intake port 73' and the vacuum port 72' are configured to be fluidly coupled to the suction fitting 78 and blower 30 of a liquid removal system 10 as discussed above with respect to the embodiment of FIGS. 1-4, although it is recognized that the vacuum tank 70' can be used in other applications. In the illustrated embodiment, the vacuum tank also includes a liquid discharge port 74' (FIG. 10) positioned on a lower surface of the vacuum tank 70'. The liquid discharge port 74' is configured to be fluidly coupled to a discharge pump 40 as discussed above with reference to FIGS. 1-4.

Figure 11A:
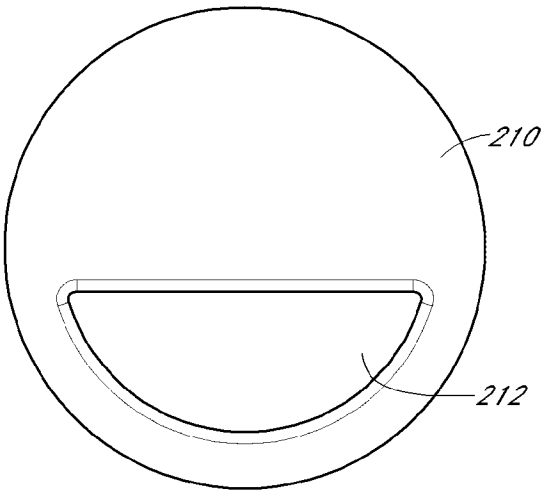
FIG. 11A is a top view of a baffle for use in a vacuum tank of a liquid removal system.
Figure 11B:
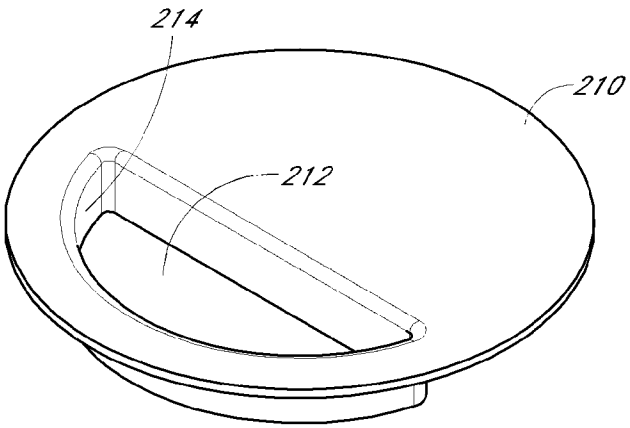
FIG. 11B is a perspective view of the baffle of FIG. 11A from a top side thereof.
Figure 12:
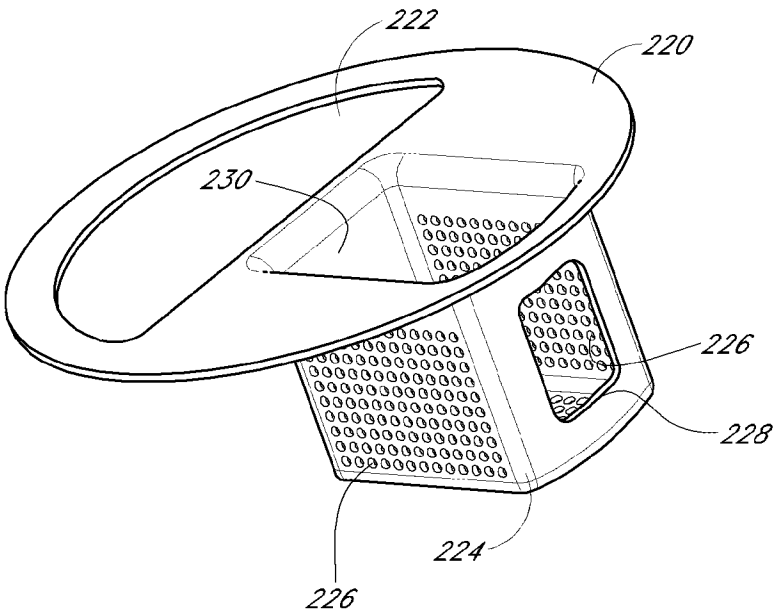
FIG. 12 is a perspective view of a liquid extractor for a vacuum tank of a liquid removal system from a top side thereof.
Figure 13:
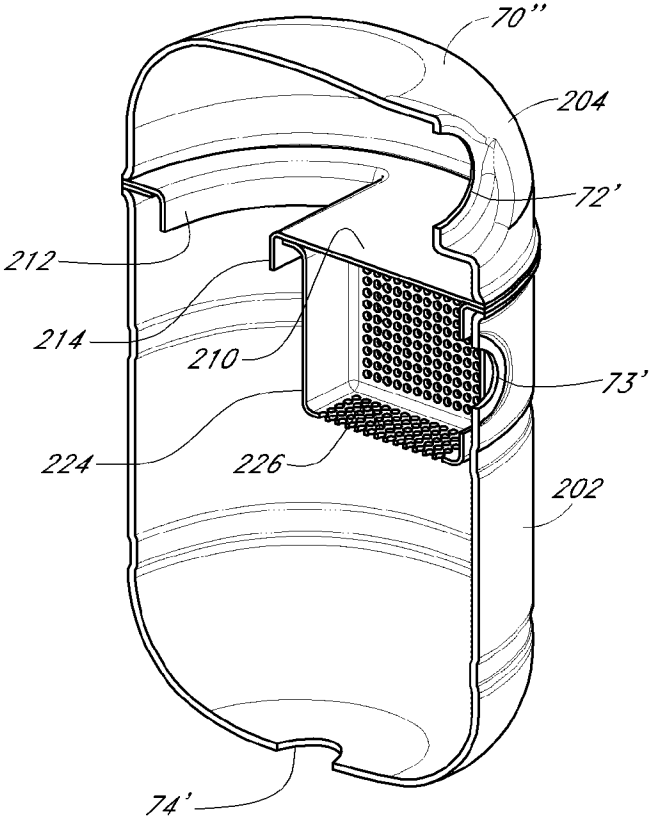
FIG. 13 is a cross-sectional view an embodiment of vacuum tank including the baffle of FIG. 11A and the liquid extractor of FIG. 12 positioned therein for use in a liquid removal system.

In other embodiments, the vacuum tank 70' of FIGS. 7-10 can be configured to further reduce noise generation of the liquid removal system 10. Noise reduction features are further illustrated in FIGS. 11-13. FIGS. 11A-B illustrate a baffle for use with a vacuum tank 70' such as that depicted in FIGS. 7-10. FIG. 12 illustrates a liquid extractor for use with a vacuum tank 70' such as illustrated in FIGS. 7-10. FIG. 13 illustrates an embodiment of vacuum tank 70" including a baffle and vacuum tank.

With reference to FIGS. 11A-B, a baffle 210 for use with a vacuum tank 70" is depicted. In the illustrated embodiment, the baffle 210 comprises a plate sized and configured to fit between a first tank portion 202 and a second tank portion 204. In other embodiments, the baffle 210 can be integrally formed with one of the tank portions 202, 204, or the baffle 210 can be configured to be retained by only one of the tank portions 202, 204. The baffle 210 includes an aperture 212 configured to allow the passage of a gas flow therethrough. The baffle can also include a flange 214 (FIG. 11B) surrounding at least a portion of the aperture. The flange 214 can be configured to couple to a liquid extractor as described in further detail below.

With reference to FIG. 12, a liquid extractor 220 for a vacuum tank 70" is depicted. The liquid extractor 220 comprises a plate sized and configured to fit between a first tank portion 202 and a second tank portion 204. In other embodiments, the liquid extractor 220 can be integrally formed with one of the tank portions 202, 204, or the liquid extractor 220 can be configured to be retained by only one of the tank portions 202, 204. The liquid extractor can include a sieve box 224 having at least one mesh side 226 allowing liquid to pass therethrough. The sieve box can have an opening 228 in one side thereof. The opening 228 can be configured to be fluidly connected to the liquid intake port 73' of the vacuum tank 70". In the illustrated embodiment, the sieve box 224 has three mesh sides 226 allowing liquid to pass therethrough and one solid wall 230 preventing liquid from passing therethrough, although in other embodiments, other arrangements of mesh sides 226 and solid walls can be used in a sieve box 224.

As illustrated in FIG. 13, the baffle 210 and the liquid extractor 220 can be retained between the first tank portion 202 and the second tank portion 204 to form a vacuum tank 70" with reduced noise generation. In the illustrated embodiment, the baffle 210 couples with the liquid extractor 220 as the flange 214 of the baffle 210 passes through an opening 222 in the liquid extractor 220. When used in a liquid removal system, suction is generated in the vacuum tank 70" by a reduction of pressure at the vacuum port 72'. This suction can draw liquid or a liquid/gas mixture through a hose to be fluidly coupled to the liquid intake port 73'. This liquid or liquid mixture then enters the sieve box 224. The liquid then escapes the sieve box through the mesh surfaces 226, where it settles in the vacuum tank until evacuation through the liquid discharge port 74'. In the illustrated vacuum tank 70", gas accompanying the liquid/gas mixture passes through the mesh surfaces 226, through the aperture 212, and toward the vacuum port 72'. Thus, the vacuum tank 70" separates liquid and gas from a mixture received at the liquid intake. Advantageously, since the sieve box 224 and baffle 210 geometry of the illustrated embodiment of vacuum tank 70" route gas flow between the liquid intake port 73' and the vacuum port 72' around a circuitous path including several substantial substantially right angles, the noise generated by the system is reduced as compared to a system with a more direct gas flow path.

Figure 14:
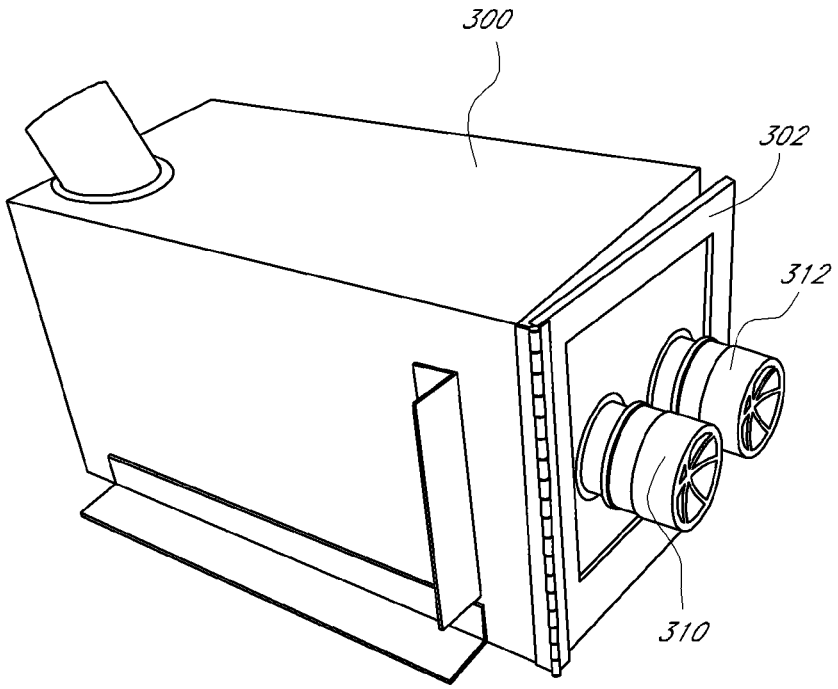
FIG. 14 is a perspective view of a liquid extractor configured to be mounted in a front panel of a liquid removal system.
Figure 15A:
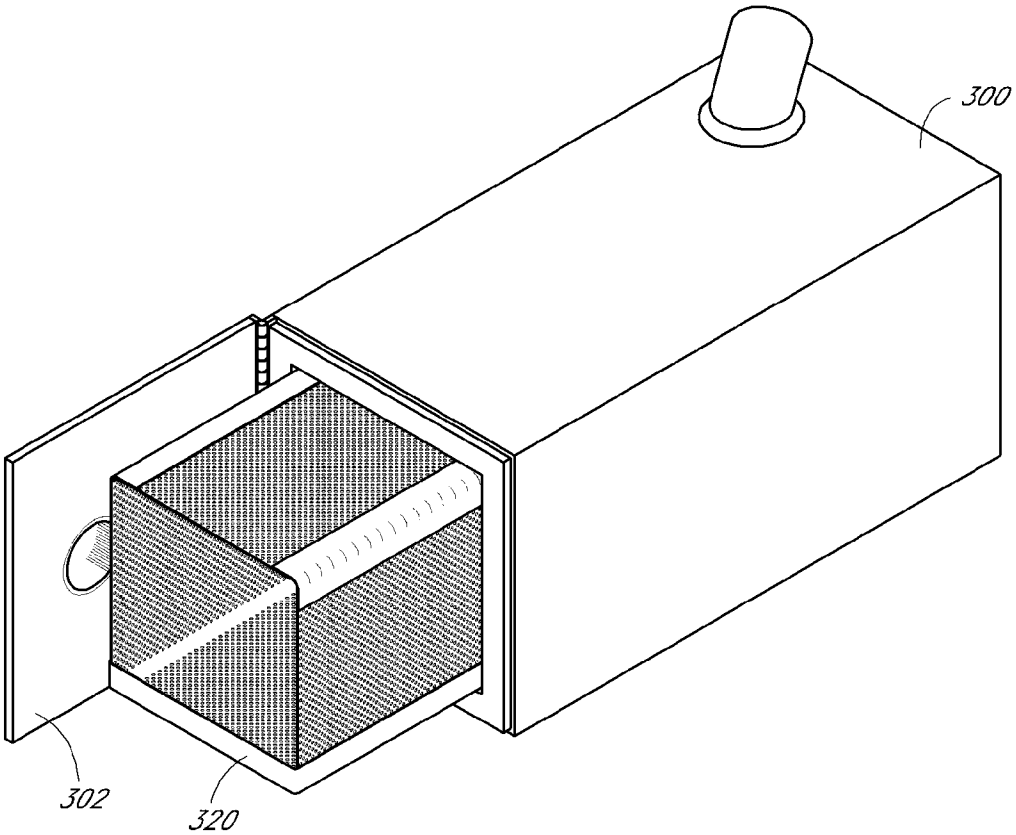
FIG. 15A is a perspective view of the liquid extractor of FIG. 14A having a sieve box partially removed.
Figure 15B:
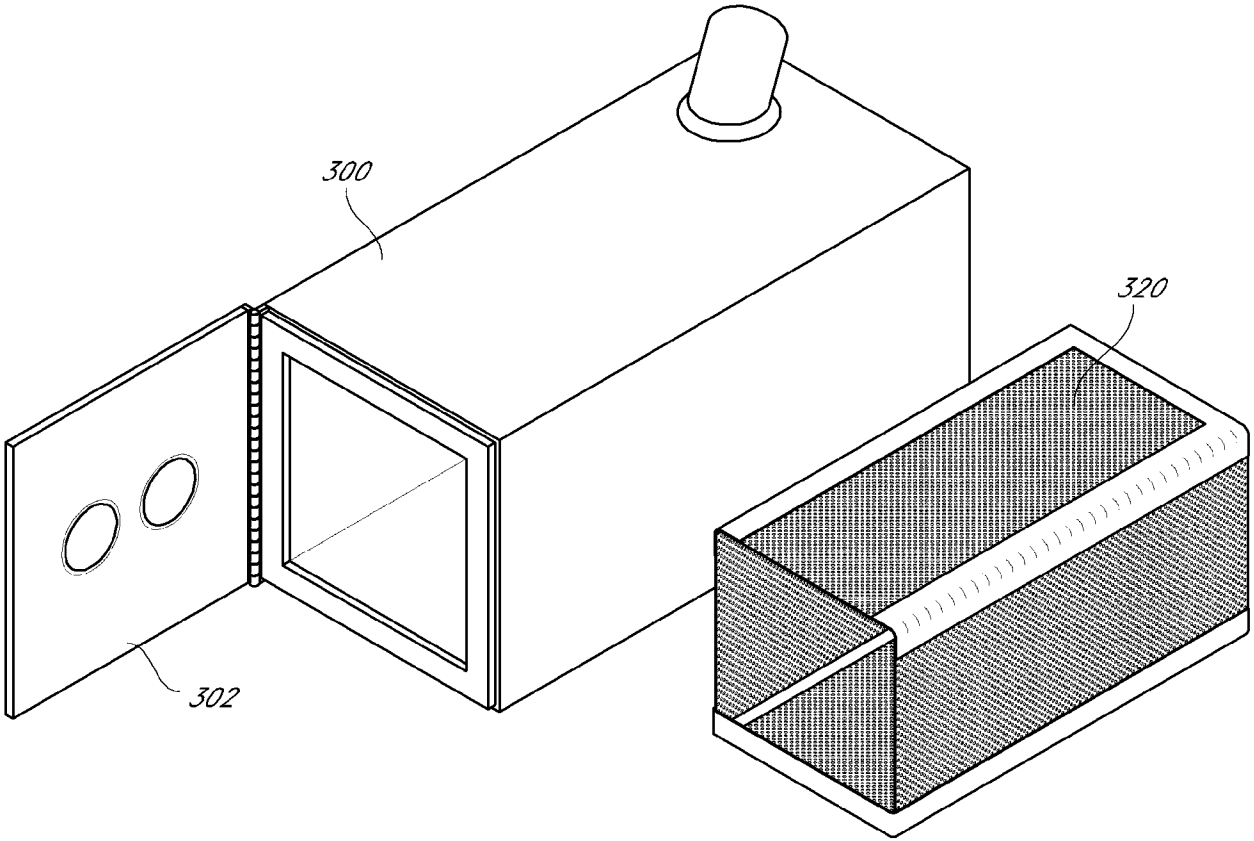
FIG. 15B is a perspective view of the liquid extractor of FIG. 14A having a sieve box removed.

With reference to FIGS. 14 and 15A-15B, in other embodiments, a liquid extractor can be positioned in a front panel of the liquid removal system 10. In these embodiments, a sieve box 320 similar to that described above with respect to the vacuum tank 70" can be positioned in fluid communication with one or more vacuum hoses at or near where the vacuum hoses enter the front panel of the liquid removal system 10. As illustrated, the sieve box 320 is a mesh box having an open front end that is positioned in a housing 300 having a hinged front door 302 on which one or more vacuum ports 310, 312 for connection with one or more vacuum hoses are positioned. While the housing 300 and sieve box 320 are illustrated as substantially rectangular prismatic components, it is contemplated that in other embodiments, different geometries, such as cylindrical housings and sieve boxes can be used. The front panel-mounted sieve box 320 can be easily accessed, for example, by pulling out a drawer in which it is positioned, such that an operator can easily access the sieve box 320 for inspection or cleaning without accessing the vacuum tank 70". FIGS. 15A and 15B illustrate a removal sequence of a front-mounted sieve box 320. The sieve box 320 can have a front lip, a handle, or another feature to allow an operator to grip the sieve box for ease of removal for cleaning. It is contemplated that the use of a front-mounted sieve box 320 is not limited to the liquid removal systems described herein. Rather, this front-mounted sieve box 320 can be incorporated into many presently-existing and possibly future developed liquid removal systems and carpet cleaning systems. In embodiments having a front-panel mounted sieve box, an additional filter can be positioned inside the liquid intake port of the vacuum tank to further filter particulate matter and prevent premature wear on the discharge pump or clogging.

Figure 16:
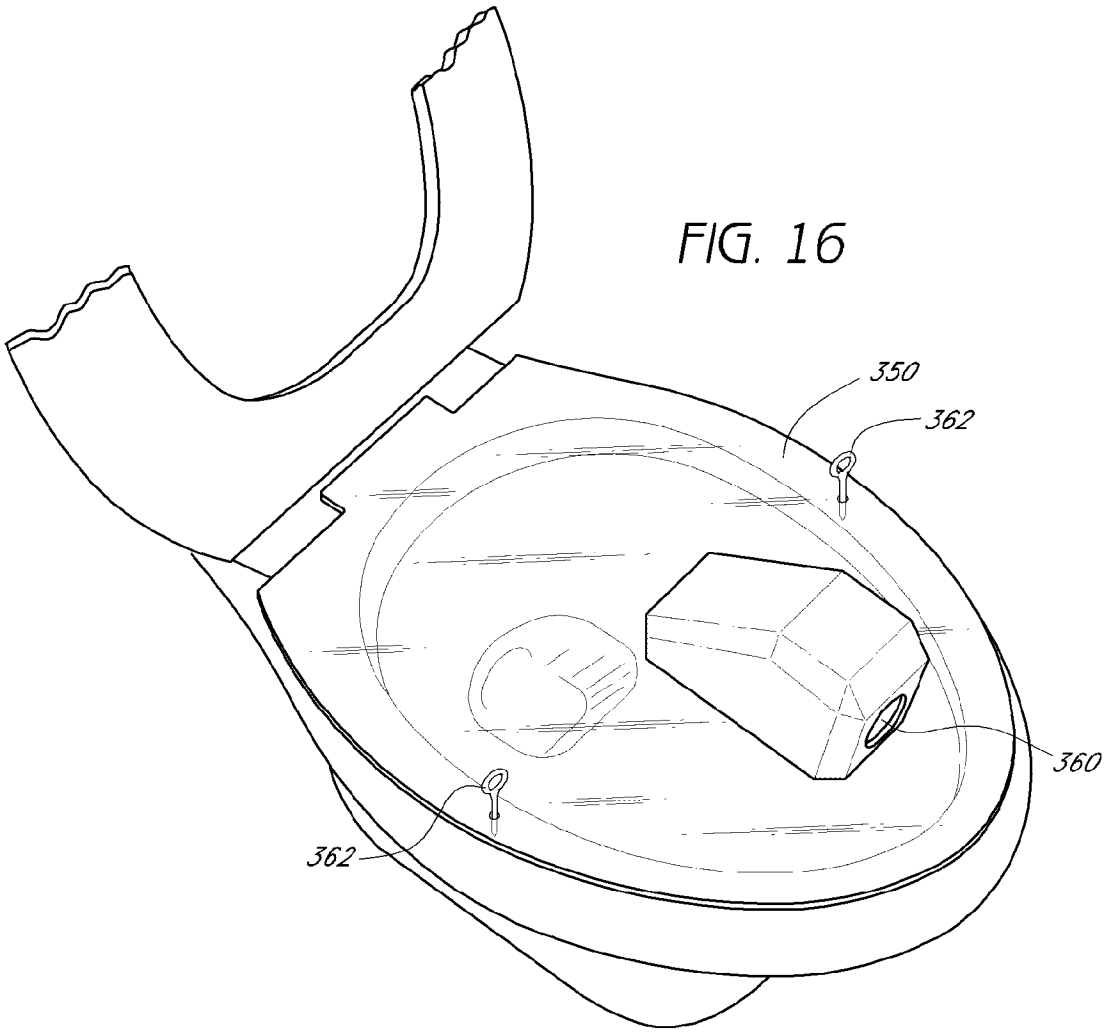
FIG. 16 is a perspective view of one embodiment of toilet splash shied for use with a liquid removal system.
Figure 17:
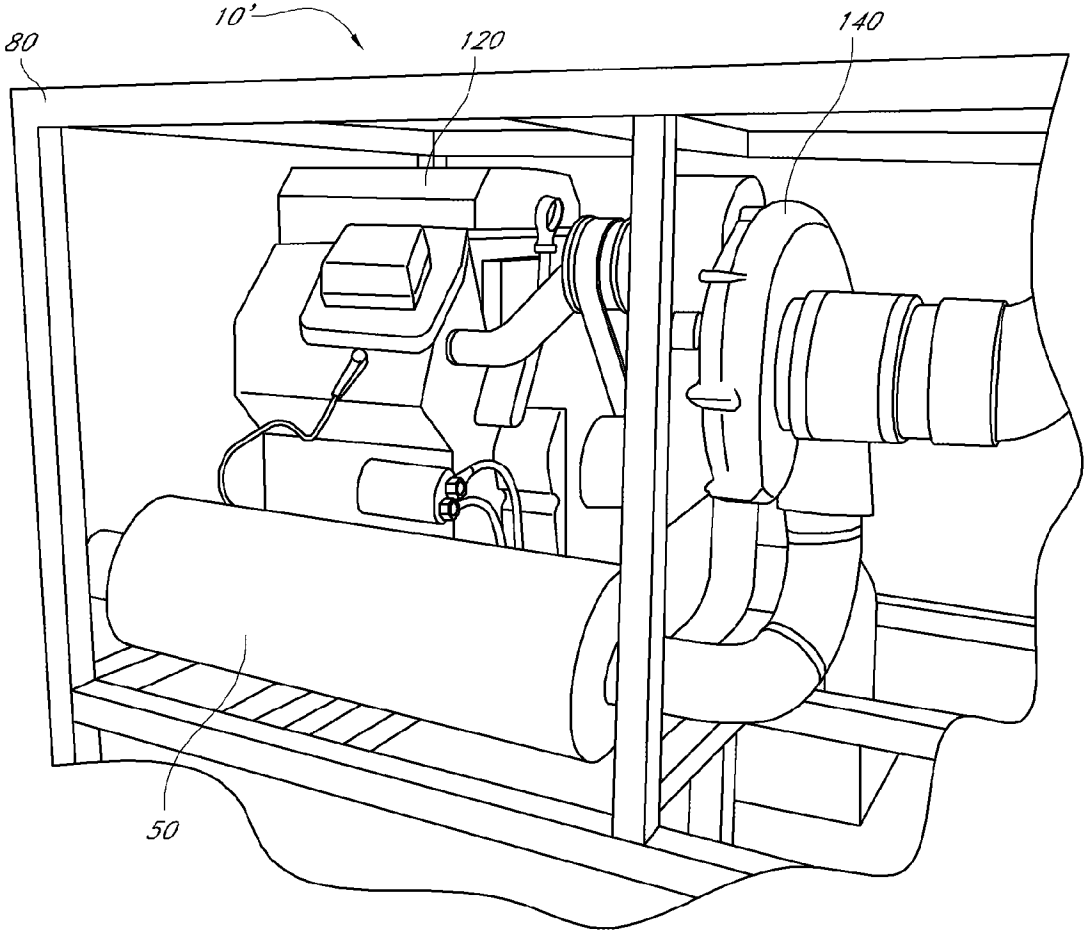
FIG. 17 is a rear perspective view of an embodiment of liquid removal system incorporating a supercharger to generate vacuum.

With reference to FIG. 16, a device to facilitate discharge of liquid from a liquid removal system 10 is depicted. It can be desirable for the liquid removal system 10 to discharge liquid through a toilet drain. In certain applications, it is contemplated that an in-toilet sewer system discharge device such as a Drain Dummies® manufactured by Cleaning Systems, Inc. can be attached to a liquid discharge hose to discharge removed liquid into the sewer system. In other circumstances, such as where the removed liquid can contain toxic substances which can be unsuitable for disposal through the sewage system, or where the sewage system of a flooded area is inoperative, it can be desirable to discharge the liquid from the discharge outlet 46 to a storage tank until it can be appropriately disposed of.

Where the removed liquid is to be discharged through a toilet, it can be desirable to route the discharge hose through a splash shield 350 to prevent liquid from escaping the toilet bowl. FIG. 16 illustrates one embodiment of splash shield. The splash shield 350 is configured to fit over a standard-sized toilet bowl rim. The splash shield 350 has a port 360 through which the discharge hose can pass. The discharge hose can then be routed through the splash shield 350 and into the drain of the toilet past the trap such that discharged liquid passes directly into the residential drain. In some embodiments, the splash shield can include a discharge hose configured to be inserted into a toilet drain as described above and having a rapid connector disposed above the port 360 of the splash shield 350. In some embodiments, the port 360, can include a cam or groove fitting of a cam lock hose fitting, configured to couple to a corresponding cam or groove fitting on a discharge end of the discharge hose. In some embodiments, the port 360 can be angled to direct a discharge flow towards the trap of the toilet such that for flows of sufficient pressure, no additional hoses leading into the trap are present. For example, the port 360 can include an angular bend from approximately 30 degrees to approximately 50 degrees, and desirably approximately 45 degrees. In embodiments having an approximately 45 degree redirecting angular bend, the discharge hose can be oriented substantially horizontally, while the discharge stream is directed at approximately 45 degrees downward and toward the toilet drain. Thus, a discharge hose from the liquid removal system can be connected to the port 360 of the splash shield 350. It is contemplated that the splash shield 350 can be secured to the toilet with one or more straps such as elastic straps or bungee cords. For example two straps could be used to secure the shield to the bowl and the tank of the toilet. The splash shield 350 can include one or more eyelets 362 or holes for attachment of the straps. While the splash shield 350 is described herein in conjunction with the discharge hose from a liquid removal system, it is contemplated that the splash shield 350 can be used with other liquid removal systems and other devices configured to drain through a toilet.

It is contemplated that other embodiments of liquid removal system having different operational capabilities can be configured through various combinations of the features discussed in more detail above. For example, FIGS. 17-21 illustrate an embodiment of liquid removal system 10' including a supercharger 140 configured to create vacuum in a vacuum tank 70'. The embodiment of FIGS. 17-21 further includes a vacuum tank 70' having a rounded profile and a front-mounted liquid extractor with a housing 300 having two suction ports 310, 312, and sieve box. In the embodiment of FIGS. 17-21, a pressure relief valve 90 can be positioned in a y-junction in the fluid connection between the supercharger 140 and the vacuum tank.

Figure 21:
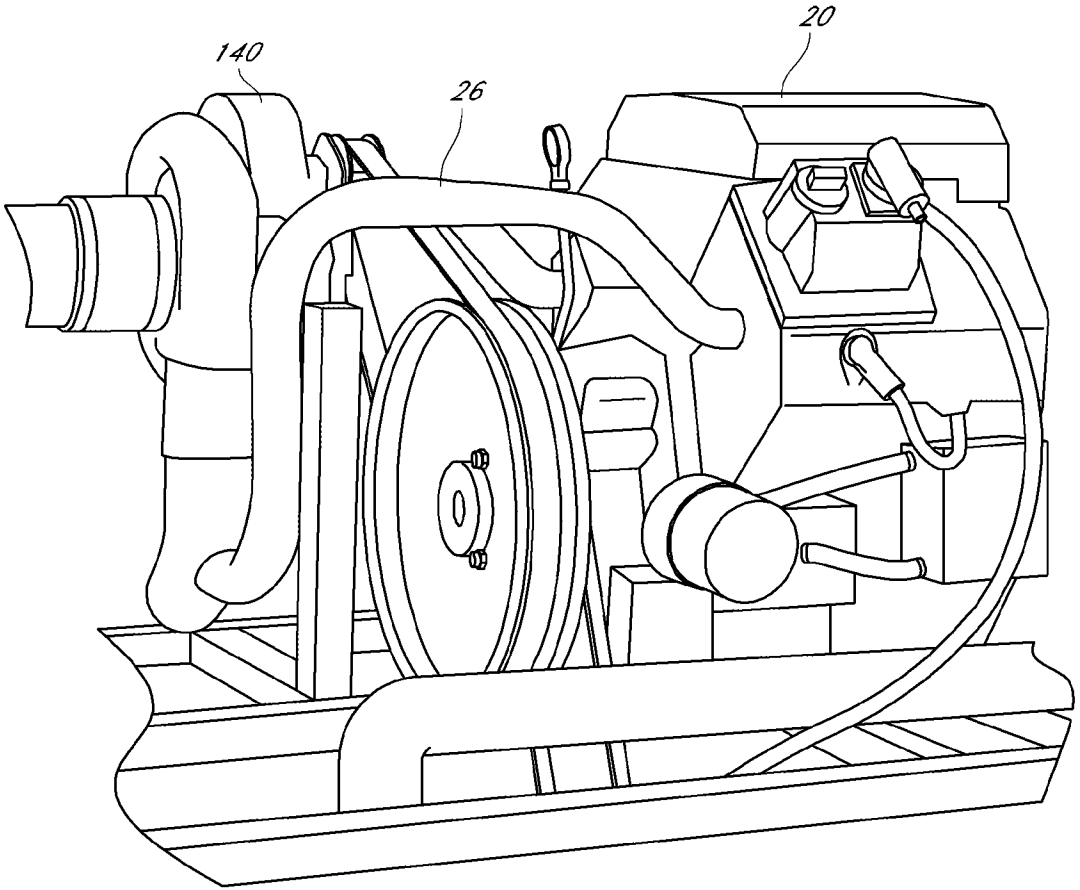
FIG. 21 is a perspective detail view of a portion of the liquid removal system of FIG. 17.
Figure 22:
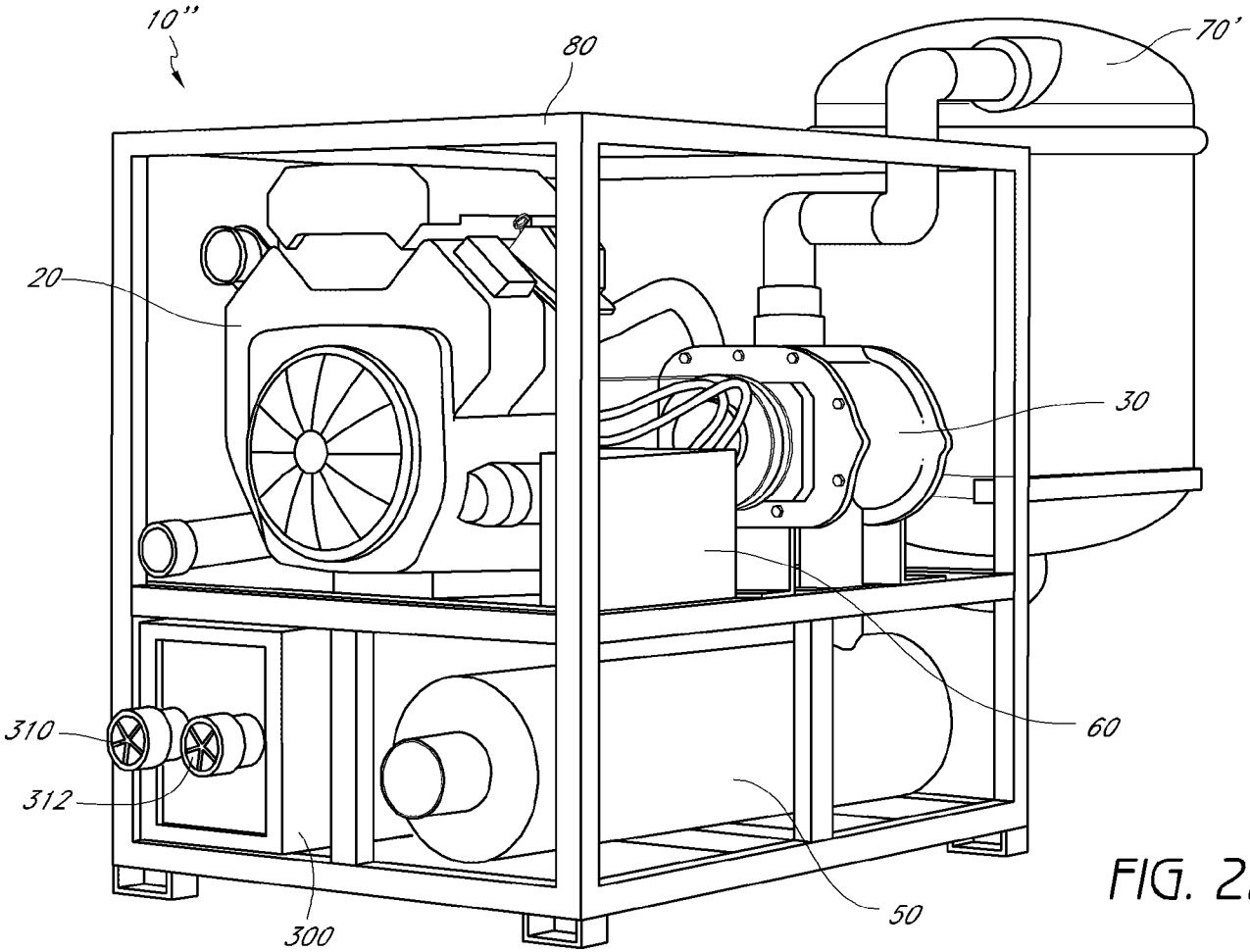
FIG. 22 is a perspective view of an embodiment of liquid removal system incorporating a front-mounted liquid extractor.
Figure 23:
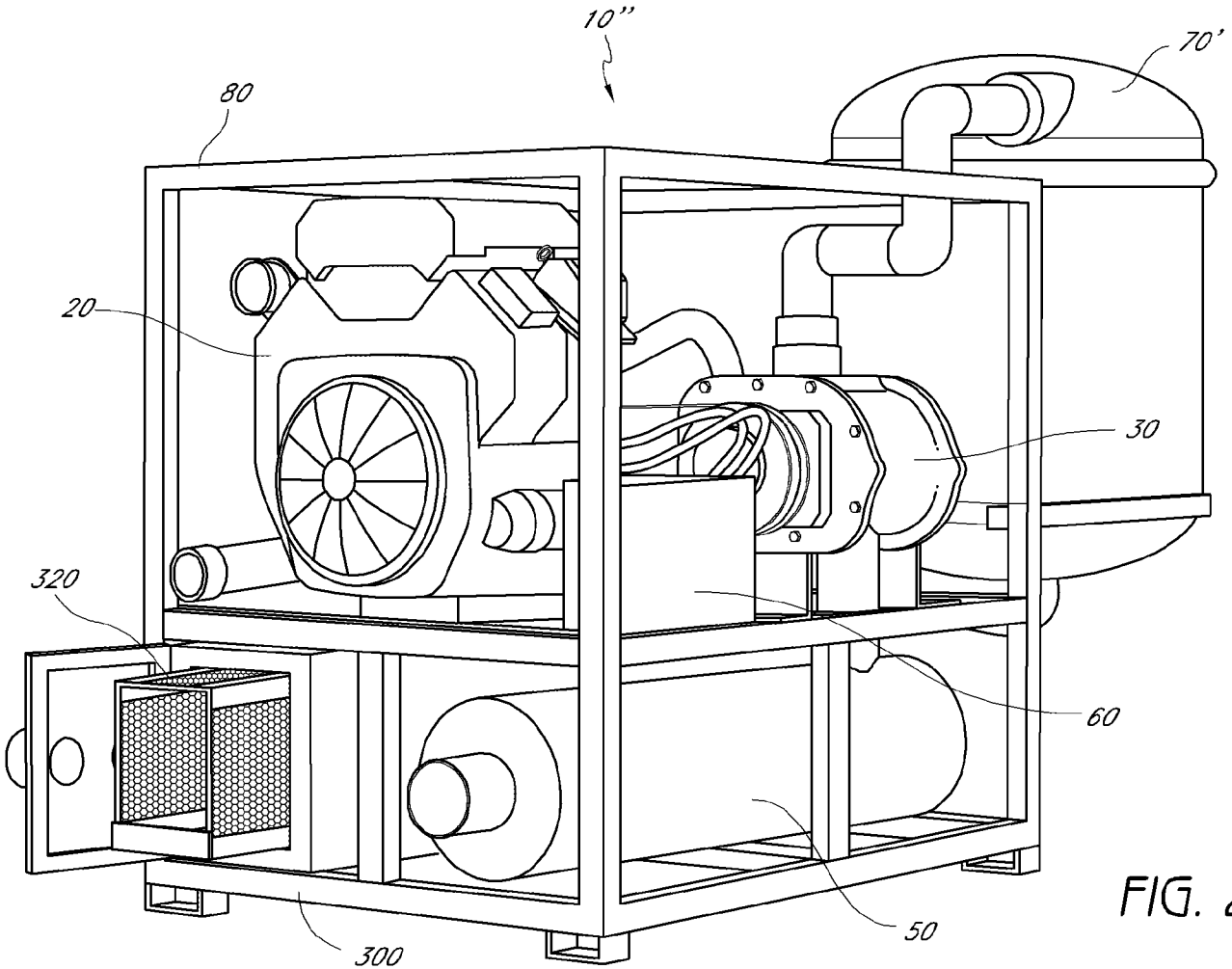
FIG. 23 is a perspective view of the liquid removal system of FIG. 22 with a panel of the liquid extractor open.
Figure 24:
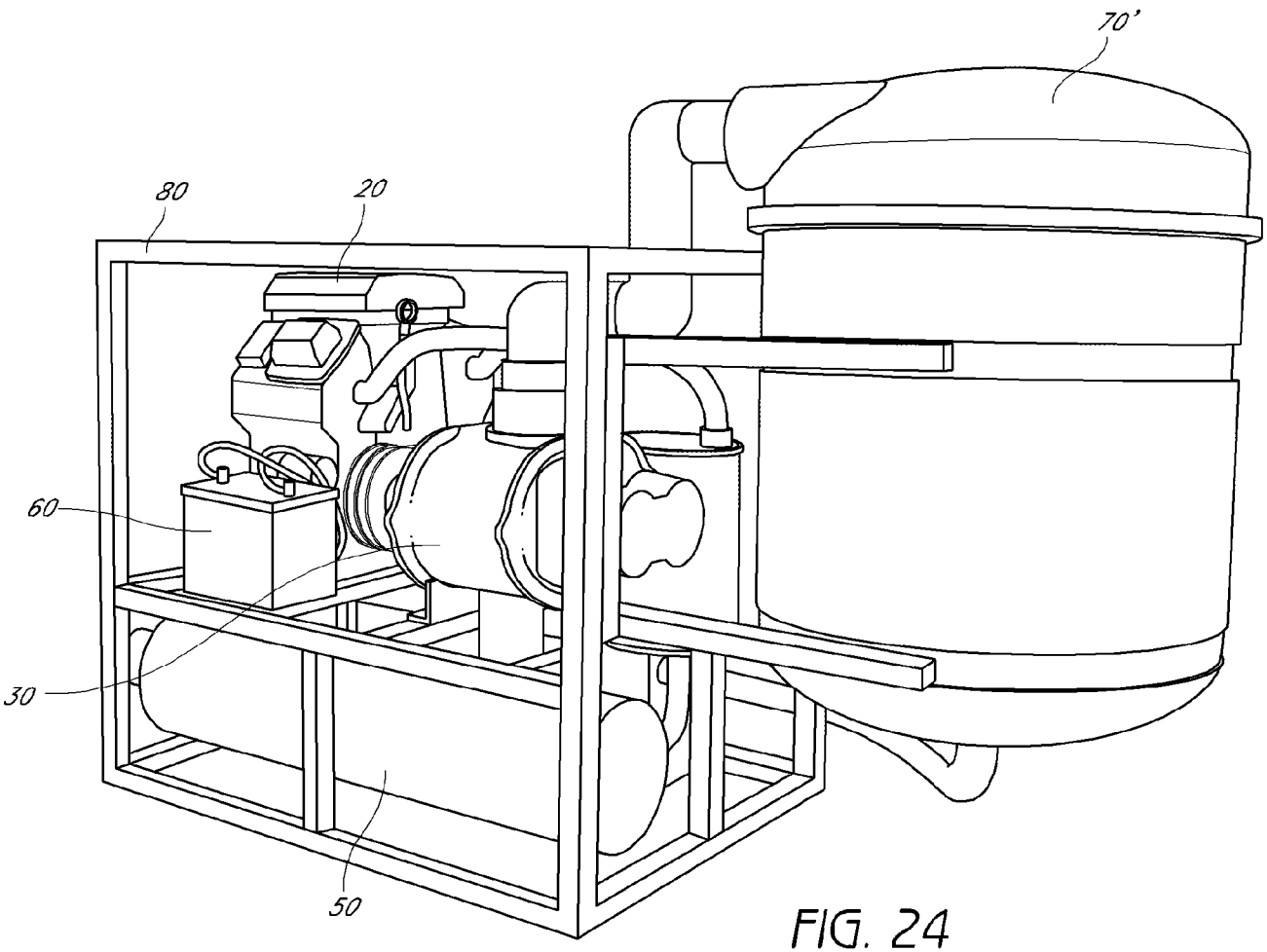
FIG. 24 is a right rear perspective view of the liquid removal system of FIG. 22.
Figure 25:
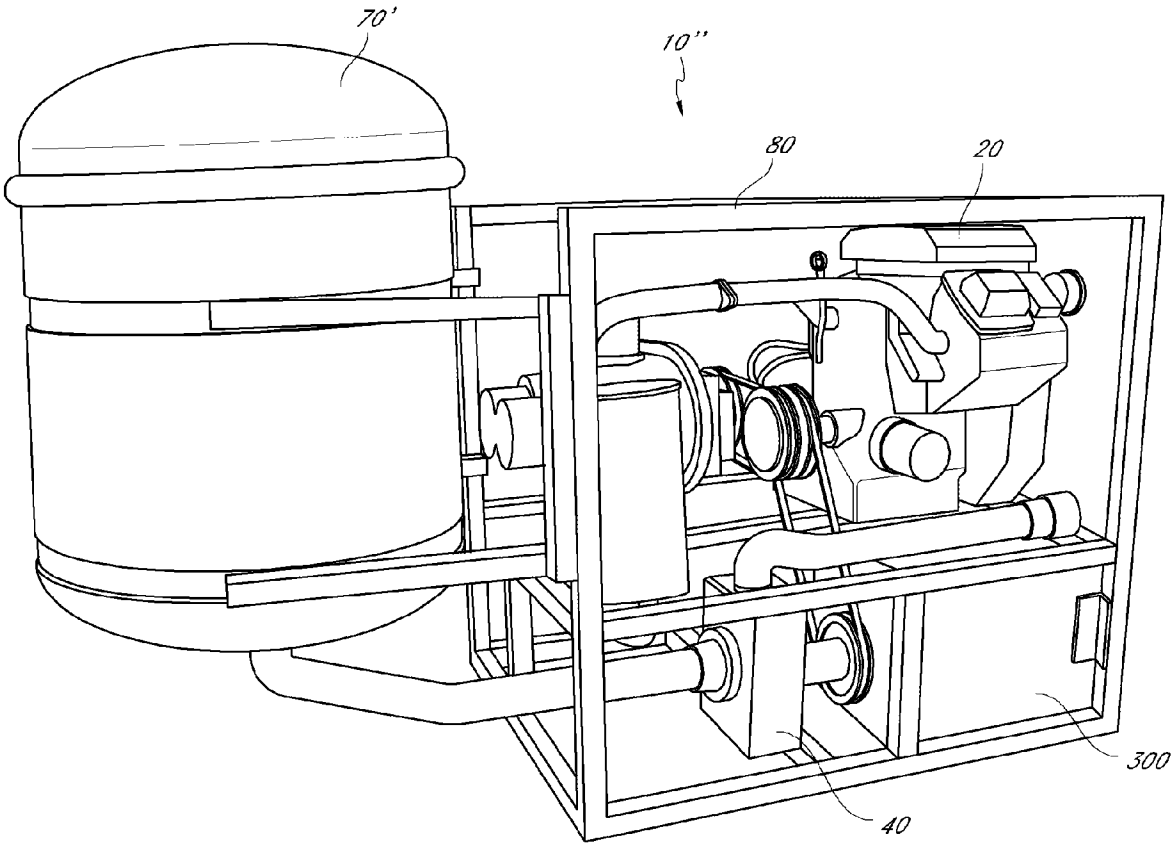
FIG. 25 is a left rear perspective view of the liquid removal system of FIG. 22.
Figure 26:
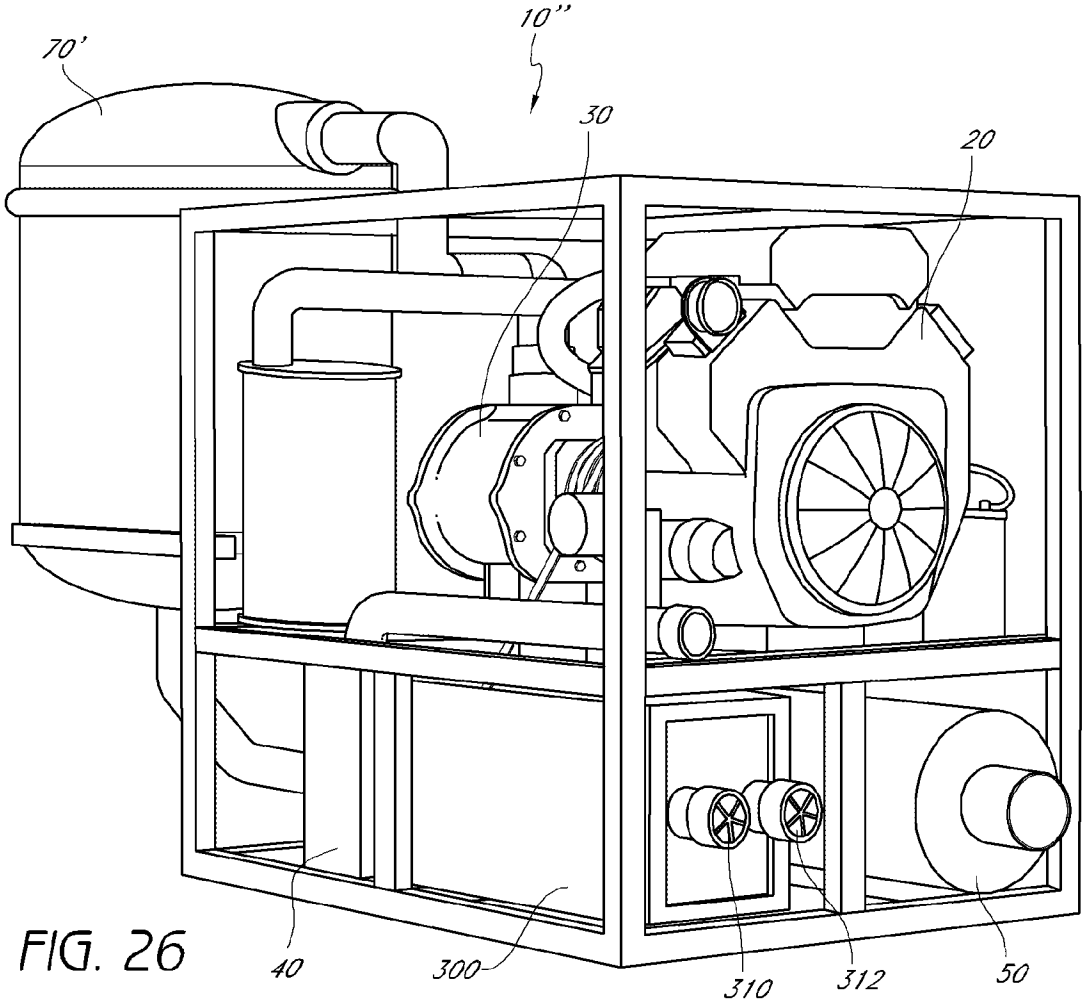
FIG. 26 is a left front perspective view of the liquid removal system of FIG. 22.

FIG. 21 illustrates the merging of the exhaust from the motor 20 over an exhaust pipe 26 to an exhaust air side of the supercharger 140 via a merged exhaust. The combined exhaust flow from the supercharger 140 and the motor 20 then flow to a silencer 50 (FIG. 17), muffler, or other sound muffling device. Advantageously, only a single exhaust system is needed to dispel exhaust gases in this embodiment. In other embodiments, the exhausts from the motor 20 and supercharger 140 can be exhausted separately.

Figure 27:
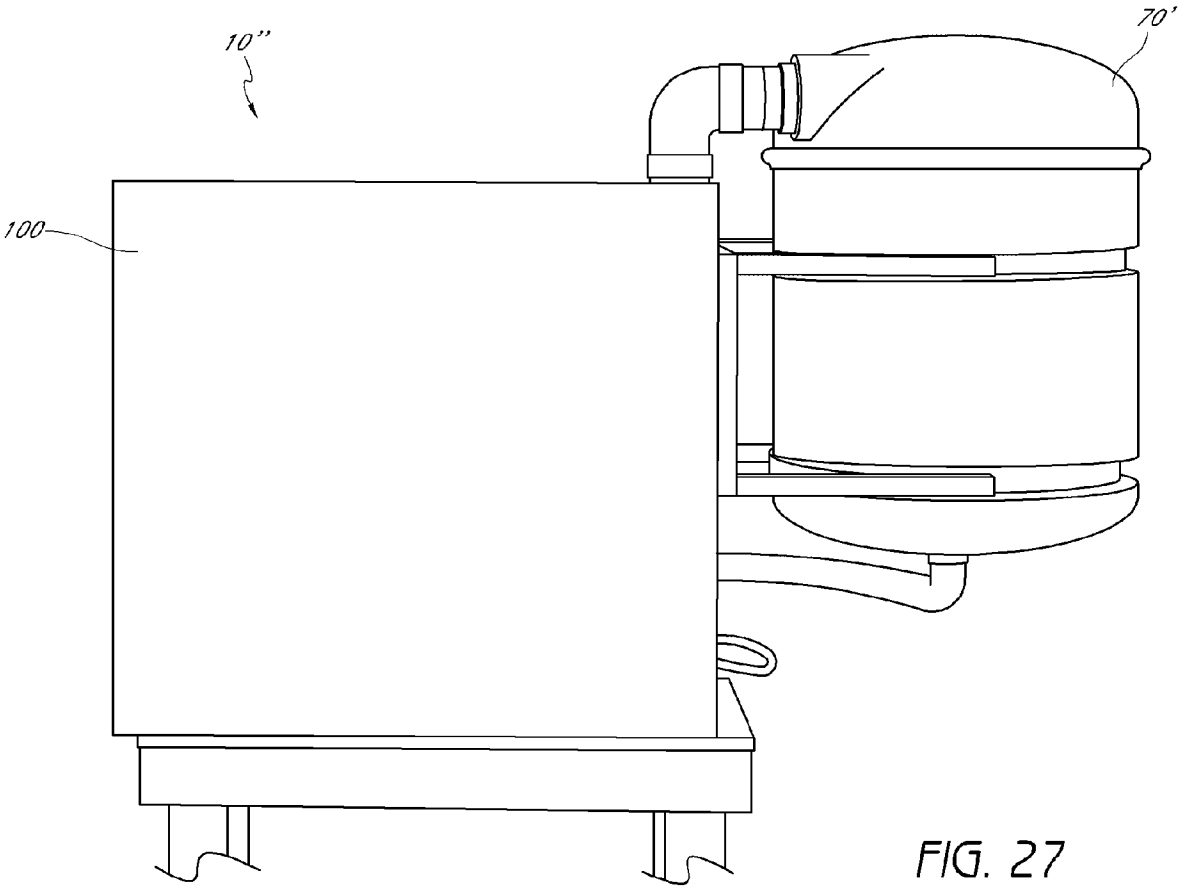
FIG. 27 is a right side view of an embodiment of liquid removal system incorporating a housing.
Figure 28:
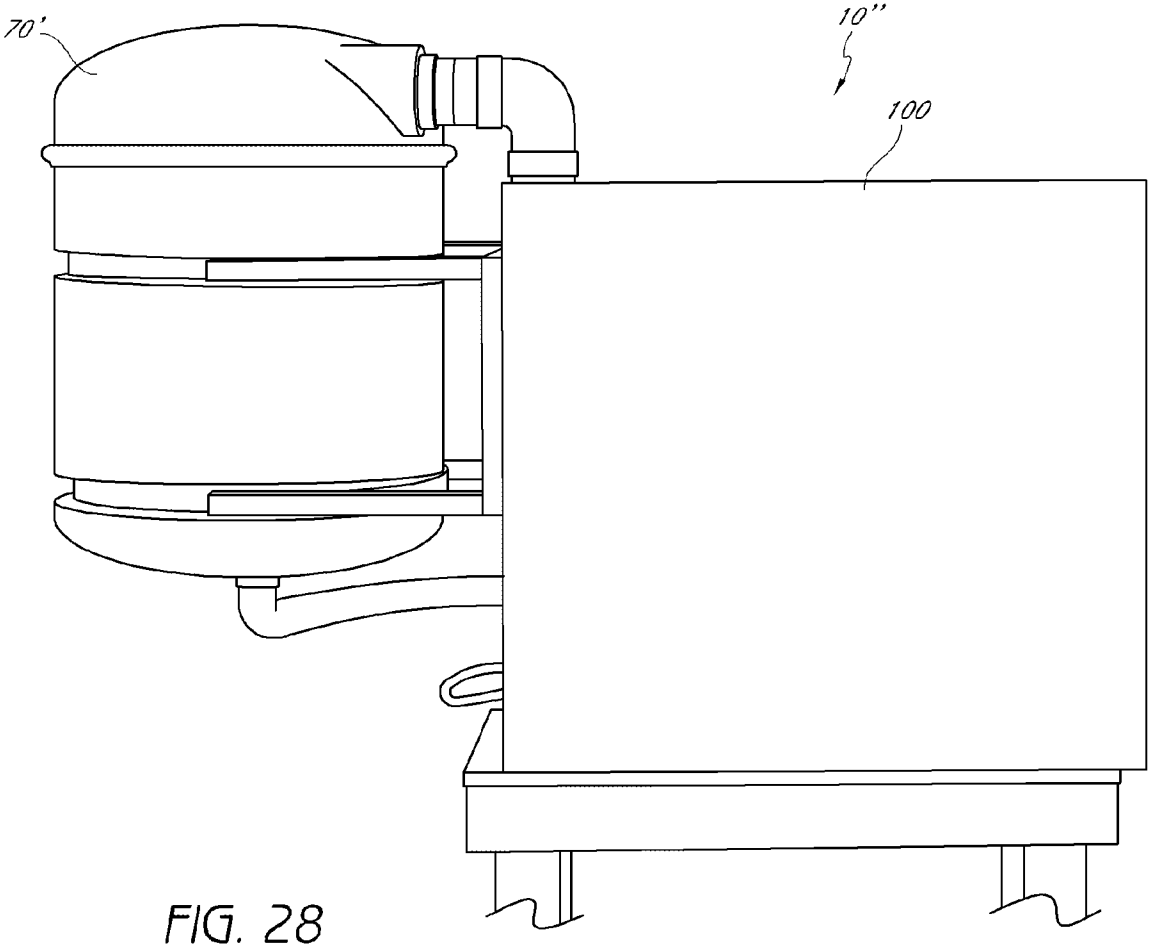
FIG. 28 is a left side view of the liquid removal system of FIG. 27.

Another embodiment of liquid removal system 10" is illustrated in FIGS. 22-26. The embodiment of FIGS. 22-26 includes a front-mounted liquid extractor having a housing 300 with a sieve box 320, vacuum ports 310, 312 for two vacuum hoses, a vacuum tank 70' having a rounded profile, and a blower 30. Another embodiment is illustrated in FIGS. 27-28. The embodiment of FIGS. 27-28 includes a housing 100 covering the components of the liquid removal system 10".

Figure 18A:
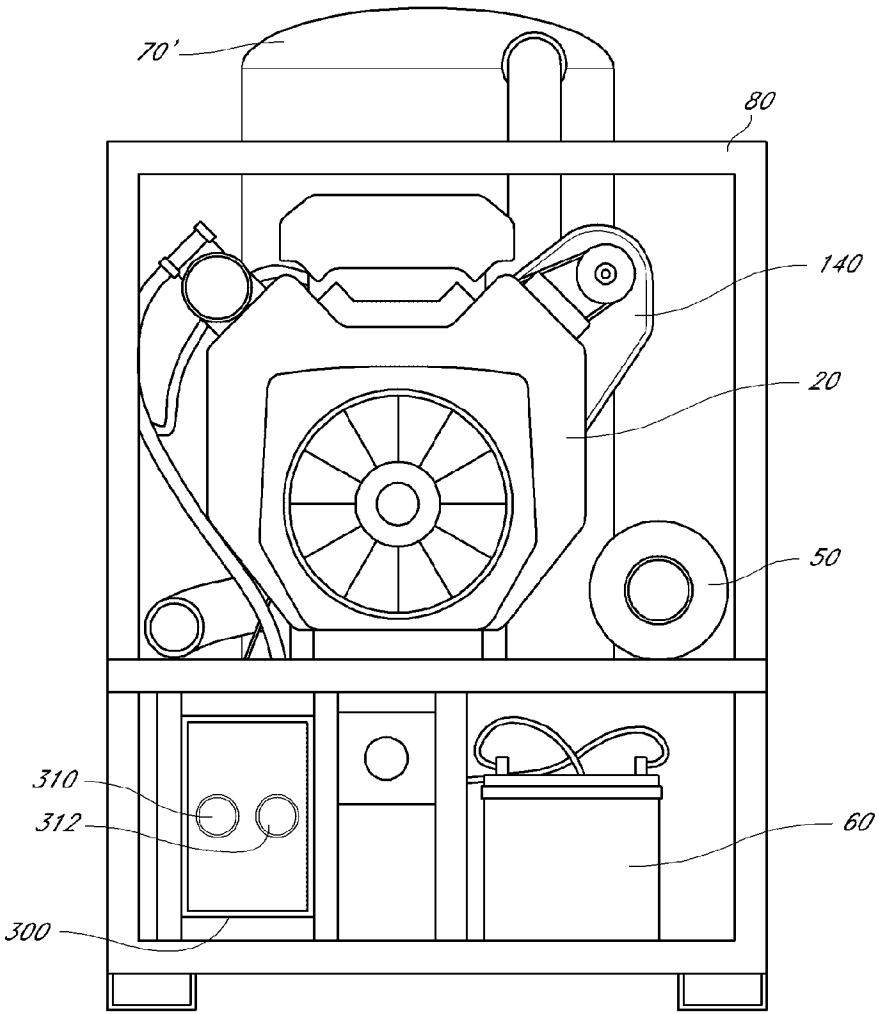
FIG. 18A is a front view of the liquid removal system of FIG. 17.
Figure 18B:
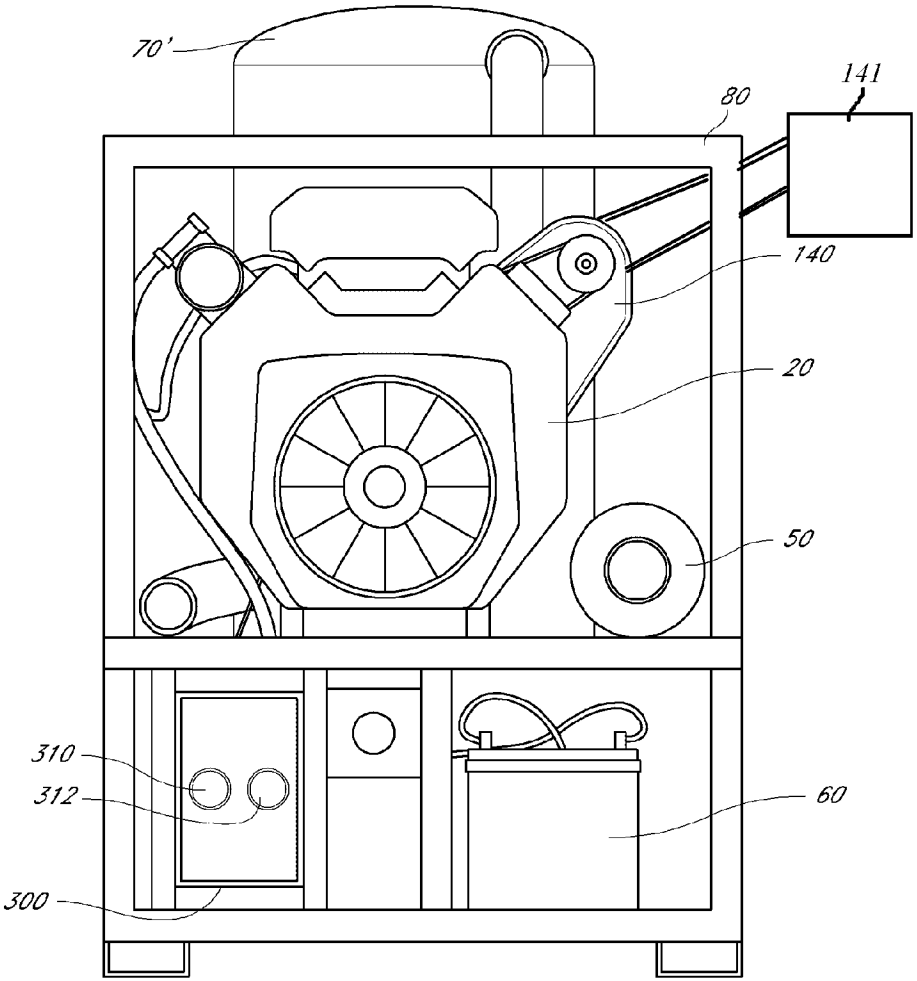
FIG. 18B is a front view of the liquid removal system of FIG. 17 incorporating a lubrication system for the supercharger.
Figure 19:
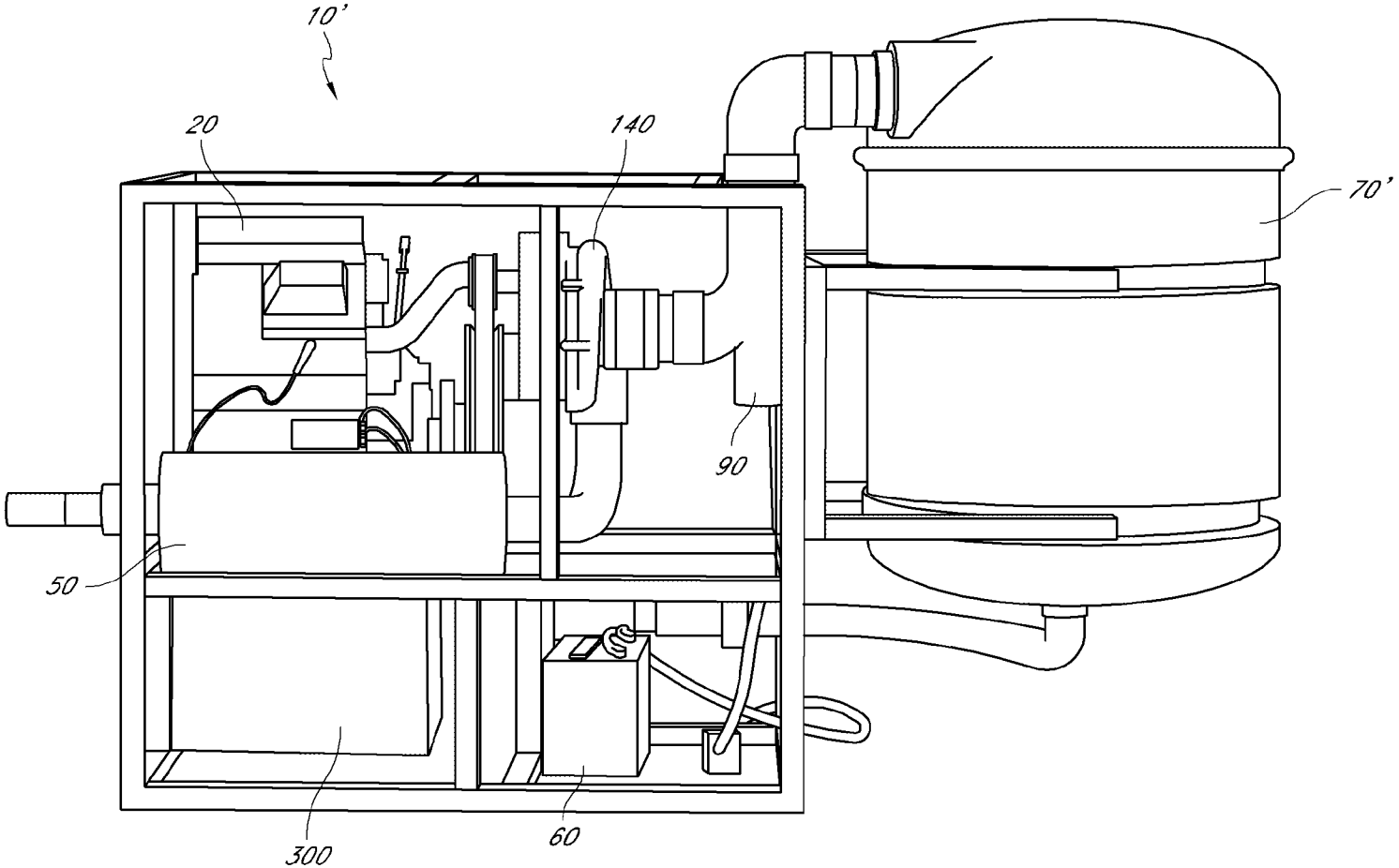
FIG. 19 is a right-side view of the liquid removal system of FIG. 17.
Figure 20:
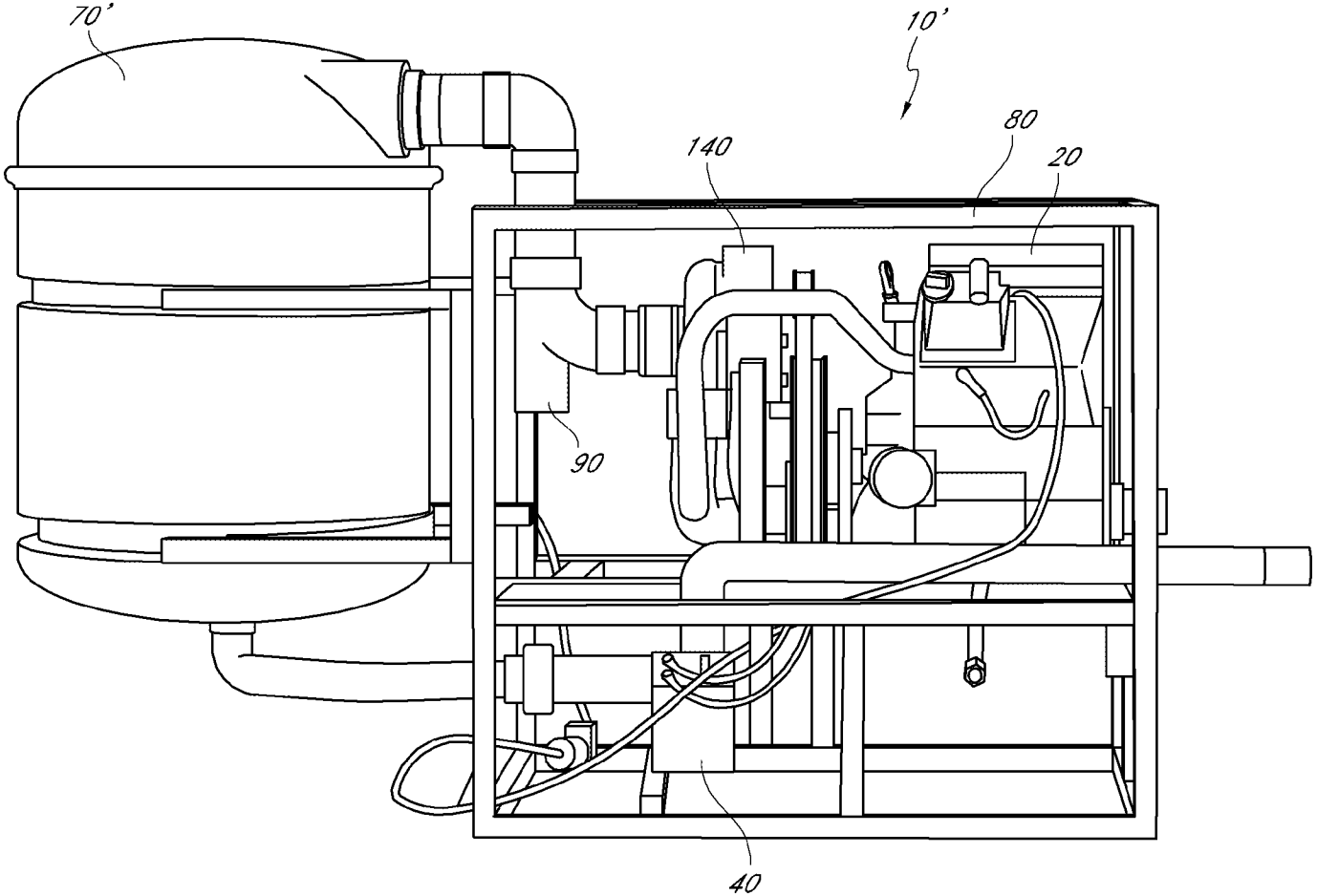
FIG. 20 is a left-side view of the liquid removal system of FIG. 17.
Figure 29:
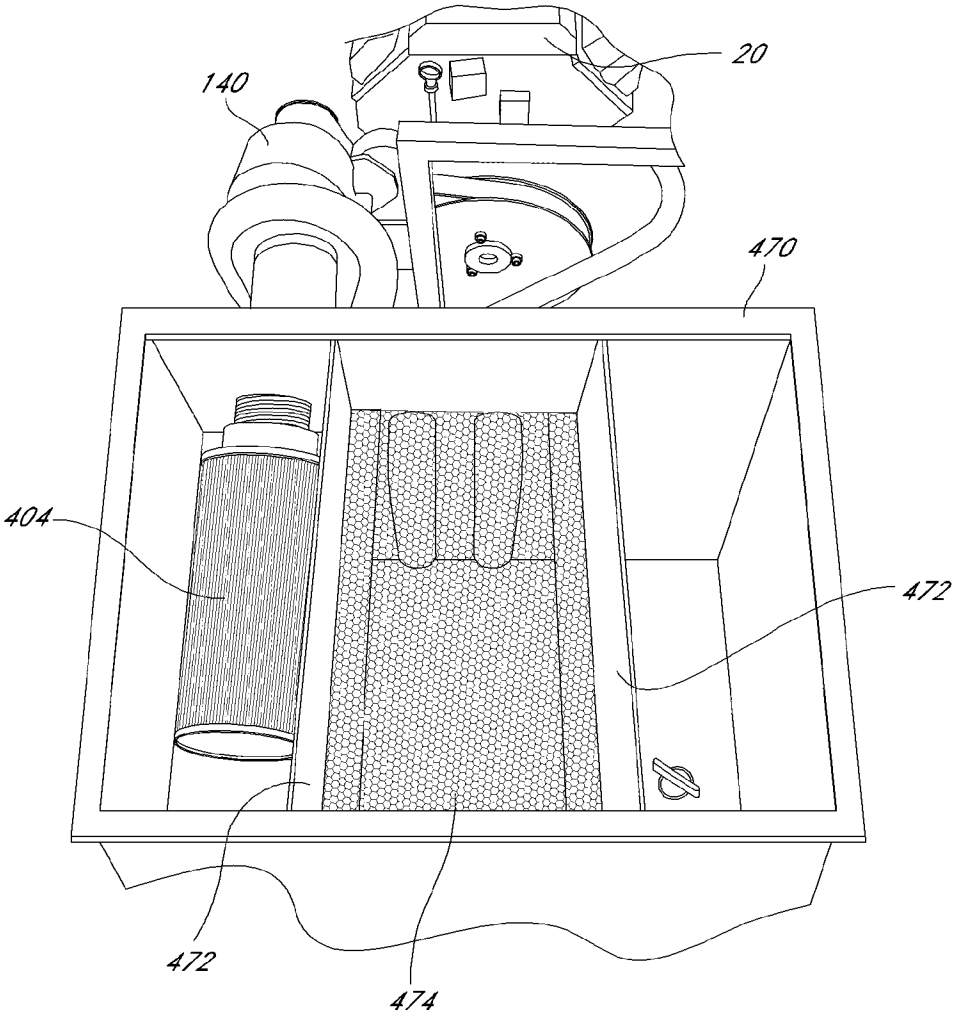
FIG. 29 is a top perspective view of a vacuum tank of an embodiment of liquid removal system incorporating a supercharger to generate vacuum with a top lid removed.
Figure 30:
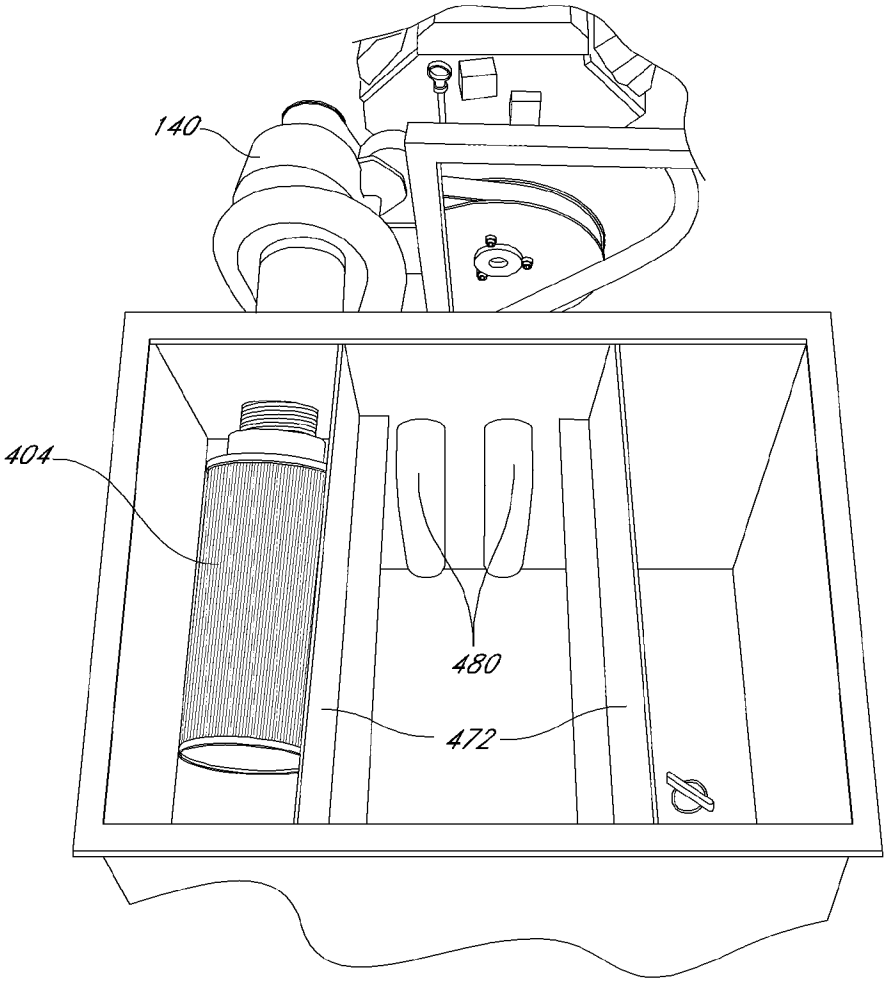
FIG. 30 is a top perspective view of the vacuum tank of FIG. 29 with a splash guard grate removed in addition to the top lid.

FIGS. 29-30 illustrate certain aspects another embodiment of liquid removal system including a centrifugal supercharger 140 to create a vacuum. The liquid removal system of FIGS. 29-30 is similar to that illustrated in FIGS. 17-21, except it has a rectangular prismatic vacuum tank 470. With reference to FIG. 29, as with the above-described embodiments, the liquid removal system includes a motor 20. In the illustrated embodiment, the motor 20 is operatively coupled to a centrifugal supercharger 140. In some embodiments, the supercharger 140 can share a lubrication system with the motor 20 such that motor oil is circulated from a crankcase of the motor to lubricate the supercharger. In other embodiments, the supercharger 140 can have a lubrication system 141 that is independent of the motor 20 as shown in FIG. 18B. In some embodiments, the liquid removal system can include an oil cooler to provide additional cooling to the motor oil. An oil cooler can be included in liquid removal system embodiments where the supercharger 140 and motor 20 share a common oil supply and in embodiments where the supercharger 140 and motor have independent lubrication systems. The oil cooler can be a finned radiator and can include an electric cooling fan to direct cooling air over the radiator fins.

As discussed above, superchargers can advantageously have reduced size, noise generation, and weight compared with a roots-type blower of similar flow capacity. In the illustrated embodiment, the supercharger can have a flow capacity of approximately 700 cubic feet per minute. The centrifugal supercharger can weigh less than approximately 30 pounds, and desirably less than approximately 20 pounds. In comparison, a roots-type blower having a flow capacity of approximately 400 cubic feet per minute typically weighs in excess of 100 pounds. In other embodiments of liquid removal system, centrifugal superchargers having different size, weight, and flow capacities can be used. The supercharger 140 is operatively coupled to a vacuum tank 470 such that operating the supercharger creates vacuum pressure within the tank 470.

The liquid removal system embodiment illustrated in FIGS. 29-30 can advantageously fit in a relatively small space. As noted above, the supercharger 140 is relatively small and lightweight in comparison to a roots-type blower. Additionally, the supercharger 140 can operate at an acceptable noise level without requiring a large silencer or other device to reduce noise generation. Thus, in the illustrated embodiment, the liquid removal system, without the vacuum tank 470, can be arranged to fit in a rectangular prism having a width of approximately 26 inches, a depth of approximately 32 inches, and a height of approximately 22.5 inches. Such an arrangement can allow the liquid removal system to be easily positioned in a vehicle such as a pick up truck or a van. Advantageously, the liquid removal system can be arranged in a van such that the front panel of the system is accessible from a side door of the van. Also, desirably, the liquid removal system is sized such that it can be easily installed and removed from a side cargo door of a van. In other embodiments, the liquid removal system can be arranged to occupy approximately 1-2 inches less space in any of the length, width, or depth dimensions than the approximate 26 inches×32 inches×22.5 inch rectangular prism described above. In still other embodiments, the liquid removal system can be arranged such that it is a shape other than a rectangular prism.

As shown in FIG. 29, the liquid removal system can include an intake filter 404 positioned within the vacuum tank 470. This intake filter 404 can prevent debris in the tank from being sucked into the supercharger 140. In some embodiments, the liquid removal system can include a vacuum relief system to prevent the vacuum tank from collapsing under the vacuum generated by the supercharger 140. The vacuum relief system can comprise a valve that is configured to open at a predetermined vacuum pressure. The valve can be positioned in a side wall of the vacuum tank 470 in some embodiments. In other embodiments, the valve can be fluidly coupled between the supercharger 140 and the vacuum tank 470 (for example, as shown in the embodiment of FIGS. 17-21). During normal operating conditions, the valve remains closed and the supercharger 140 generates a vacuum in the vacuum tank 470. However, as the vacuum generated in the tank 470 approaches the predetermined vacuum pressure, which, is desirably an acceptable margin less than a collapse pressure of the vacuum tank, the valve opens and allows ambient air to enter the tank.

In the embodiments illustrated in FIGS. 29-30, the vacuum tank 470 is a substantially rectangular prism-shaped welded metal tank. In the illustrated embodiment, the tank has dimensions of approximately 22 inches in height, 18 inches in length, and 26 inches in width. It is contemplated that in other embodiments, the tank could be a rectangular prism that is smaller or larger in any of the dimensions. Also, while the illustrated vacuum tank 470 is a substantially rectangular prism-shaped welded metal tank, it is recognized that the tank can have other shapes and sizes, such as the tank examples provided above (e.g. tank embodiments 70, 70', 70" described herein).

FIGS. 29-30 illustrate the inside of the vacuum tank 470. In the illustrated embodiment, the tank includes baffle plates 472 and a diffusion grate 474. As illustrated, the baffle plates 472 and diffusion grate 474 are sized and positioned to reduce the possibility that suctioned water can enter the supercharger 140.

FIG. 30 illustrates the vacuum tank with the diffusion grate 474 removed to reveal liquid intake ports 480. The liquid intake ports 480 are fluidly coupled to suction fittings 310, 312 (see, for example, FIG. 17) on the liquid removal system. The illustrated embodiment of liquid removal system has two liquid intake ports 480 in the vacuum tank 470, but other embodiments can have more or fewer liquid intake ports 480. Desirably, the number and size of liquid intake ports 480 can support a desired liquid intake flow capacity of the liquid removal system. While the illustrated embodiment includes two liquid intake ports 480 fluidly coupled to two suction fittings 478, in other embodiments, the number and size of liquid intake ports 480 can differ from the number and size of suction fittings 310, 312.

Figure 31:
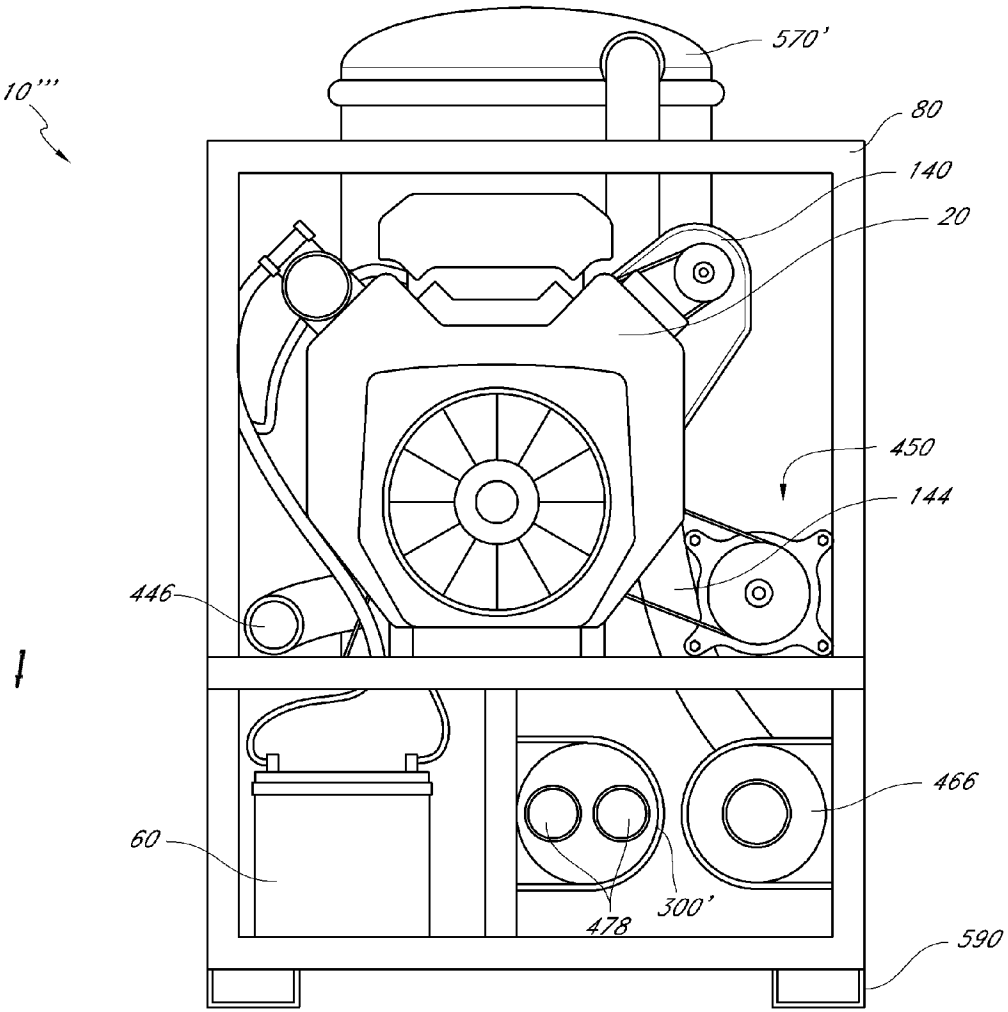
FIG. 31 is a front view of a liquid removal system incorporating a supercharger to generate vacuum with its housing cover and front panel removed.

FIGS. 31-35 illustrate various aspects of another embodiment of liquid removal system 10'" having suction generated by a supercharger 140, a front-mounted liquid extractor having a cylindrical housing 300', and a rounded vacuum tank 570. FIG. 31 illustrates a front view of the liquid removal system 10'". Visible in the front view are two suction fittings 478 to which vacuum hoses can be attached. In the illustrated embodiment, the suction fittings 478 are positioned on a removable front panel of a liquid extractor having a substantially cylindrical housing 300'. Advantageously, two vacuum hoses can be used simultaneously, one fluidly coupled to each suction fitting 478. If only a single vacuum hose is to be used, one of the suction fittings 478 can be plugged or capped. While the illustrated embodiment of includes two suction fittings 478, other embodiments can have more or fewer suction fittings 478.

In the illustrated embodiment, the liquid extractor comprises a substantially cylindrical housing 300' having a removable mesh sieve box or liquid filter placed therein. During operation of the liquid removal system 10'", suctioned water enters the liquid extractor housing through the suction fittings 478, passes through holes in the mesh sieve box, then exits the housing 300' through outlets fluidly coupled to the liquid intake ports 480 of the vacuum tank. Thus, during operation, debris can be trapped in the mesh sieve box and is prevented from entering the vacuum tank 70'. The mesh filter element can easily be removed for cleaning by removing the front panel of the liquid extractor and removing the filter. In other embodiments, other shapes and configurations of liquid extractor can be used in the liquid removal system. For example, the liquid extractor described above with respect to FIGS. 14-15 can be used in the system described herein. In other embodiments, the liquid extractor can be mounted in a filter box that is external to the liquid removal system, but fluidly coupled to the vacuum tank.

With reference to FIG. 31, also visible from the front view of the liquid removal system is the liquid outlet port 446. A discharge hose can be coupled to the liquid outlet port 446, such as by cam lock fittings. Cam lock fittings include a cam fitting, typically disposed on an end of the hose, and a groove fitting, typically on the liquid outlet port. When the hose is coupled to the outlet port 446, lever arms extending from the cam can be rotated to engage the cam in the groove, thus securing the discharge hose to the liquid outlet port 446. A cam lock fitting can allow rapid connection and disconnection of the discharge hose from the liquid removal system, while minimizing leakage due to misalignment of the hose and liquid outlet port 446. In other embodiments, such as those described above, the liquid removal system can include cam-lock fittings for both the suction and discharge sides such that both vacuum and discharge hoses can be quickly connected to the liquid removal system.

With reference to FIG. 31, a mounting location 450 for optional equipment is adjacent to the motor 20. While the liquid removal system described herein can be packaged to fit within a relatively small space in a vehicle, in some embodiments, the liquid removal system includes additional space for optional equipment to be mounted to the liquid removal system for additional capabilities. In some embodiments, the motor 20 can be positioned recessed from the front of the liquid removal device to accommodate a larger mount 450 for the clean water pump.

For example, in some applications, such as sewage spill removal, it can be desirable to wash the affected area with an antimicrobial solution and to rinse with clean water before or while suctioning the liquid away. Thus, it can be desirable to include a "clean" water pump in some embodiments of liquid removal system to apply clean water to an area. The clean water pump can be an electrically-driven pump, or it can be a mechanically driven pump, coupled to the motor 20 similar to the liquid discharge pump 40. Where it is mechanically-driven, the clean water pump can be selectively actuatable, for example with a mechanical or electronic clutch assembly. The clean water pump can sit in the mounting location 450, can be fluidly connected via hose to a water supply such as a municipal water line (e.g. a hose tap), or a reservoir, and can supply water to a cleaning wand to be applied at a desired location. Advantageously, the clean water pump can provide a relatively high pressure stream of water for clean-up regardless of the water pressure supplied over a municipal water line. In some embodiments, the water pump can include a liquid pickup such as a venture-type pickup fluidly coupled thereto to introduce chemical cleaning agents to the water being pumped. In some embodiments, the liquid pickup can be selectively actuated by a user through, for example, a switch on a front panel of the liquid removal system or on a cleaning wand fluidly coupled to the system. Thus, during operation of the clean water pump, a user can select between flow of clean water or a cleaning chemical solution. In some embodiments, the clean water pump can be an electric pump capable of delivering water at approximately 400 psi to supply water to an approximately 1½ inch diameter hose. In other embodiments, the clean water pump can operate at greater than or less than 400 psi.

Figure 32:
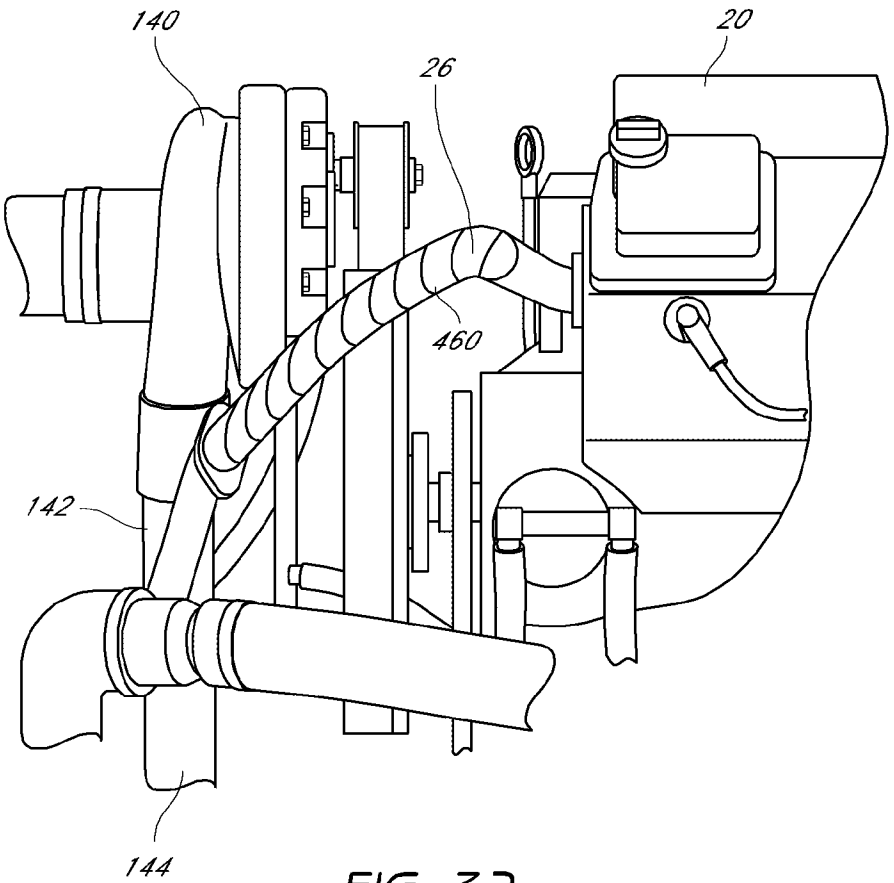
FIG. 32 is a side view of a motor exhaust pipe of the liquid removal system of FIG. 31.

With reference to FIGS. 31-32, exhaust routing for the motor 20 and supercharger 140 is illustrated. As shown in FIG. 32, exhaust gases leave the motor 20 through an exhaust pipe 26. In the illustrated embodiment, the exhaust pipe 26 is wrapped with a heat insulative exhaust wrap 460. In other embodiments, the exhaust pipe 26 can be coated with a heat treatment coating such as a ceramic coating. As illustrated in FIG. 32, the exhaust pipe 26 from the motor 20 is merged with an exhaust line 142 from the supercharger 140 to form a merged exhaust line 144. As illustrated in FIG. 31, this merged exhaust line 144 feeds into a muffler 466. In the illustrated embodiment, exhaust gases exit the muffler 466 at the front panel of the liquid removal system.

Figure 33:
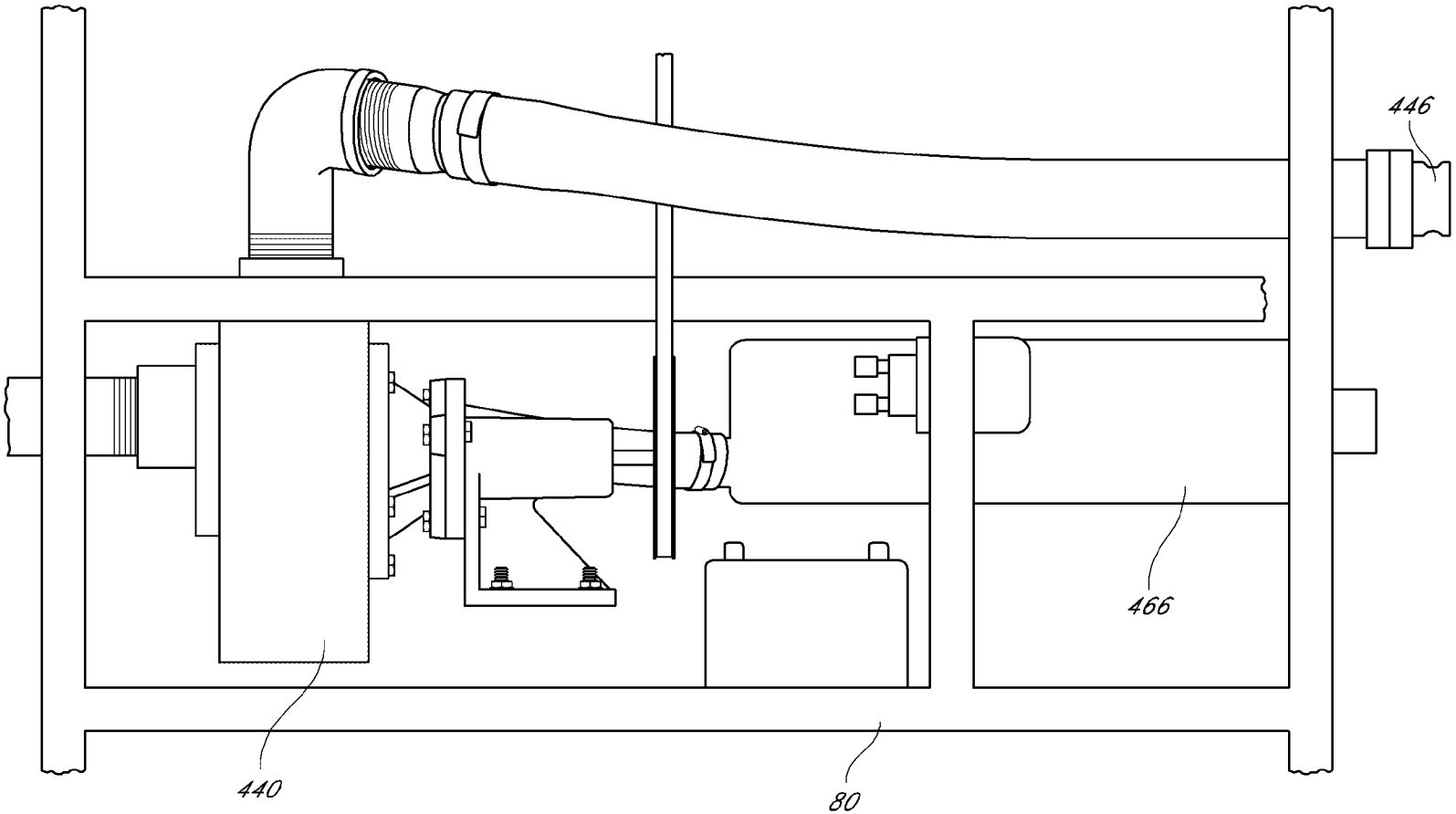
FIG. 33 is a side view of the liquid discharge pump of the liquid removal system of FIG. 31.

With reference to FIG. 33, the liquid removal system includes a discharge pump 440. As described above with respect to other embodiments, the discharge pump 440 is driven by the motor 20, and evacuates liquid from the vacuum tank 470.

Figure 34:
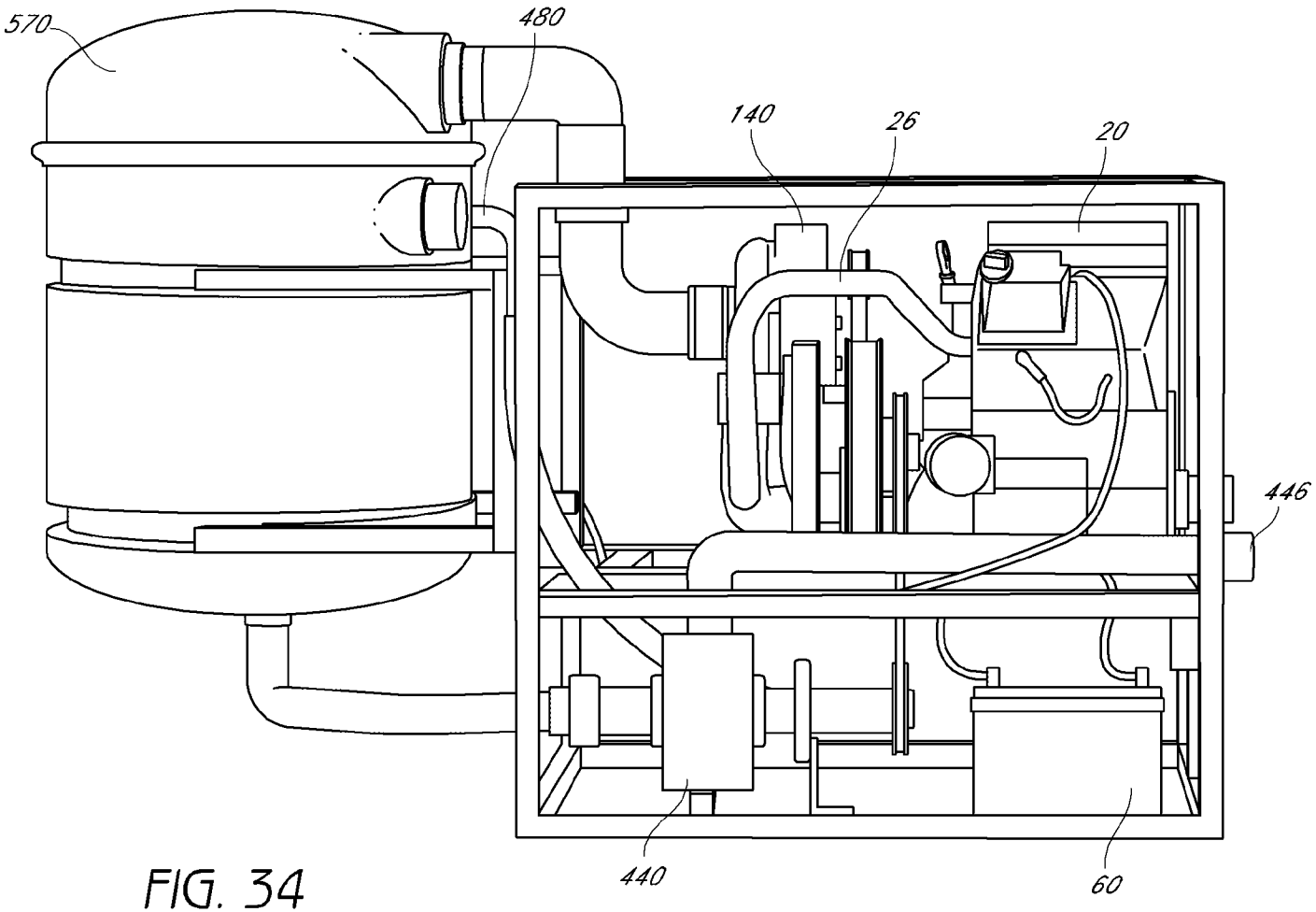
FIG. 34 is a left side view of the liquid removal system of FIG. 31.
Figure 35:
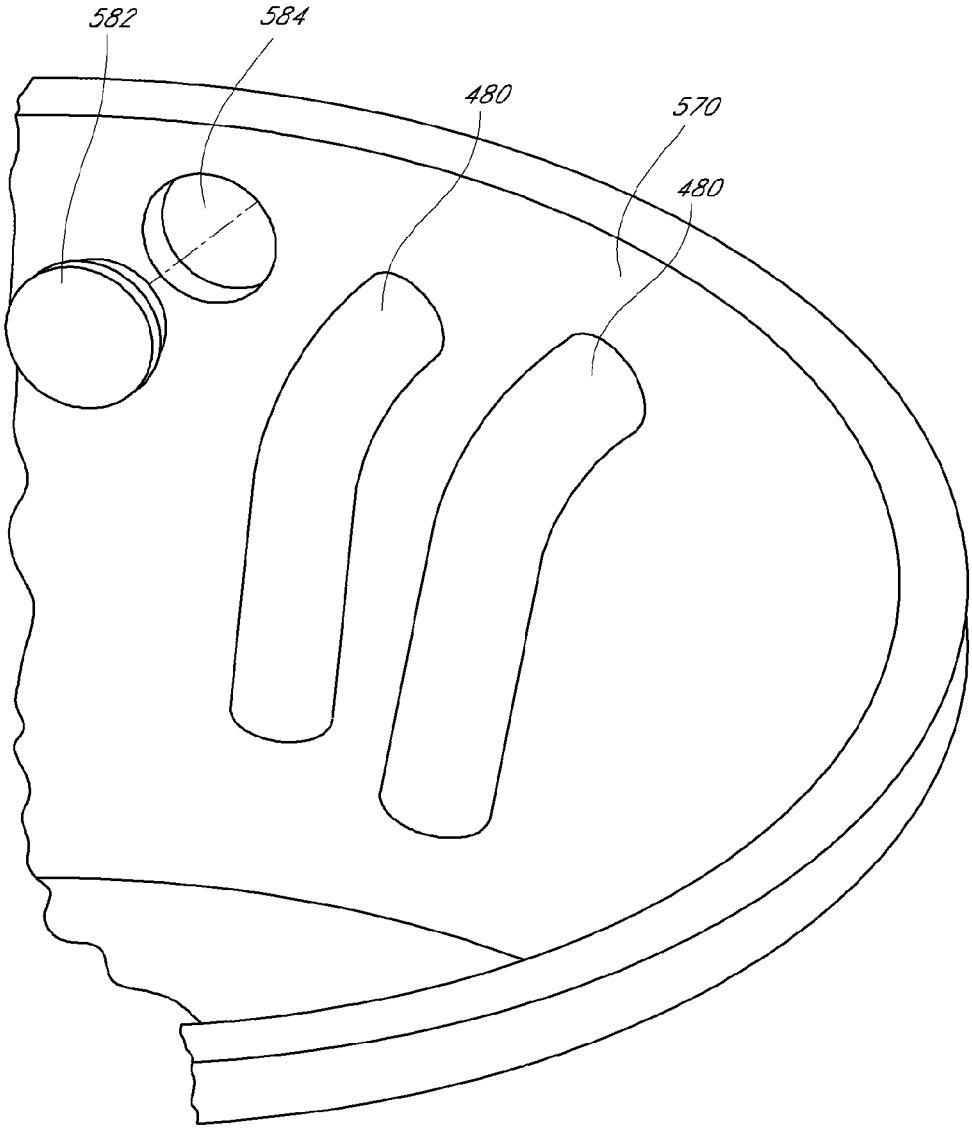
FIG. 35 is a top view of an inside of the vacuum tank of the liquid removal system of FIG. 31 including a location for a pressure relief system.

FIGS. 34-35 illustrate the generally cylindrical vacuum tank 570 of the liquid removal system 10'''. This vacuum tank 570 is similar to that described above with reference to FIGS. 7-10. Advantageously, the generally cylindrical tank 570 can have reduced intake liquid splashing as compared with a rectangular prismatic tank. The vacuum tank 570 can preferably be formed by rotomolding to allow rapid, relatively low cost manufacture.

In the illustrated embodiment of FIGS. 34-35, liquid intake ports 480 in the tank 570 can be fluidly coupled to liquid intake hoses, which can be positioned as desired to suction liquid. A motor-driven liquid transportation pump 440 can evacuate liquid that has been suctioned into the suction tank. The components of the illustrated liquid removal system 10''' are desirably arranged such that the liquid removal system fits within a relatively compact package. As illustrated, the liquid removal system can be inserted through a side cargo door opening of a van such that a front panel of the liquid removal system is accessible from the side cargo door of the van.

With respect to FIG. 31, the liquid removal system includes a plurality of skids 590 mounted to a lower surface thereof. The skids 590 each have a passageway therein to accommodate a load fork of a forklift, such that the skid 590 can allow the liquid removal system 10''' to be easily lifted with a forklift. Desirably, the liquid removal system can easily be raised onto, or lowered from, a vehicle mount, using a fork lift. Similar sleeves 590 can be incorporated into other embodiments of liquid removal system described herein.

FIG. 35 illustrates the inside of the vacuum tank 570 of the liquid removal system 10'''. The entry of the liquid intake ports 580 to the vacuum tank 570 is shown. While the illustrated embodiment has two liquid intake ports 580, it is contemplated that other embodiments of vacuum tank 570 can have more or fewer than two liquid intake ports 580. FIG. 35 also illustrates a port 584 into which a cap 582 can be inserted. In other embodiments, a vacuum relief valve can be fluidly coupled to the port 584. The vacuum relief valve can function as described above with respect to other liquid removal system embodiments to prevent the vacuum tank 570 from collapsing. In other embodiments in the vacuum tank 570 does not include the port 584. In liquid removal system embodiments having a port-less vacuum tank, a vacuum relief valve can be included elsewhere in the liquid removal system such as fluidly coupled between the supercharger 140 and the vacuum tank 570.

Figure 36A:
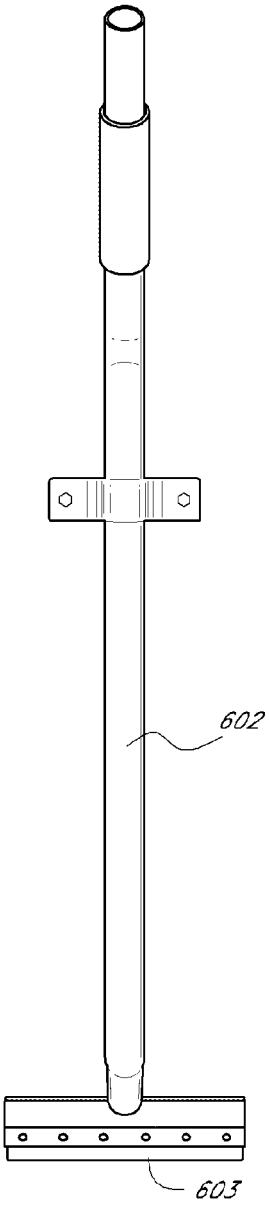
FIG. 36A is a front view of one embodiment of cleaning wand for a liquid removal system.
Figure 36B:
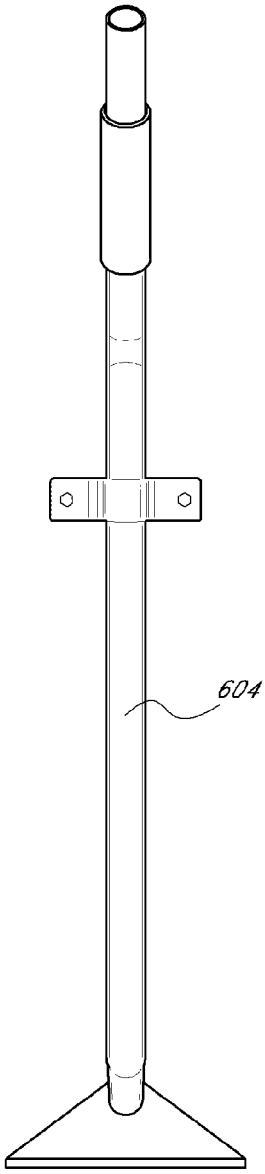
FIG. 36B is a front view of another embodiment of cleaning wand for a liquid removal system.
Figure 36C:
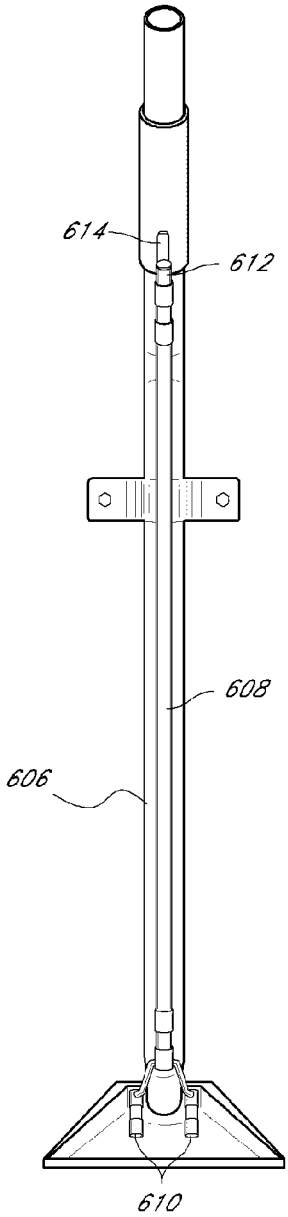
FIG. 36C is a front view of another embodiment of cleaning wand for a liquid removal system.

FIGS. 36A-36C illustrate various embodiments of a cleaning wand 602, 604, 606 that can be used with the liquid removal systems described herein. The cleaning wands 602, 604, 606 can be fluidly coupled to the suction fittings of the liquid removal system to allow a user to more easily direct the suction generated by the liquid removal system than is possible with a flexible suction hose. As illustrated, the wands 602, 604, 606 are substantially hollow tubes through which suction is applied by the liquid removal system.

With continued reference to FIGS. 36A-36C, different cleaning heads can provide advantages for cleaning different surfaces. For example, one embodiment of cleaning wand 602 includes a rubber blade 603, or squeegee, to direct water on a planar surface such as a floor. As shown in FIG. 36C, one embodiment of cleaning wand 606 is adapted for use in a sewage spill removal system as described above, or other applications requiring the application of liquid and removal of liquid. As illustrated, the wand 606 includes a liquid spray system including a hose 608 fluidly coupling a liquid inlet fitting 612 to two spray nozzles 610. A flow of liquid through the liquid spray system can be selectively initiated, adjusted, and terminated with a grip lever 614 that is coupled to a valve. In some embodiments, the liquid spray system of the cleaning wand 606 can be fluidly coupled to a clean water pump as is described in connection with sewage spill removal above. In other embodiments, the liquid spray system can be fluidly coupled to a different liquid source.

Figure 37:
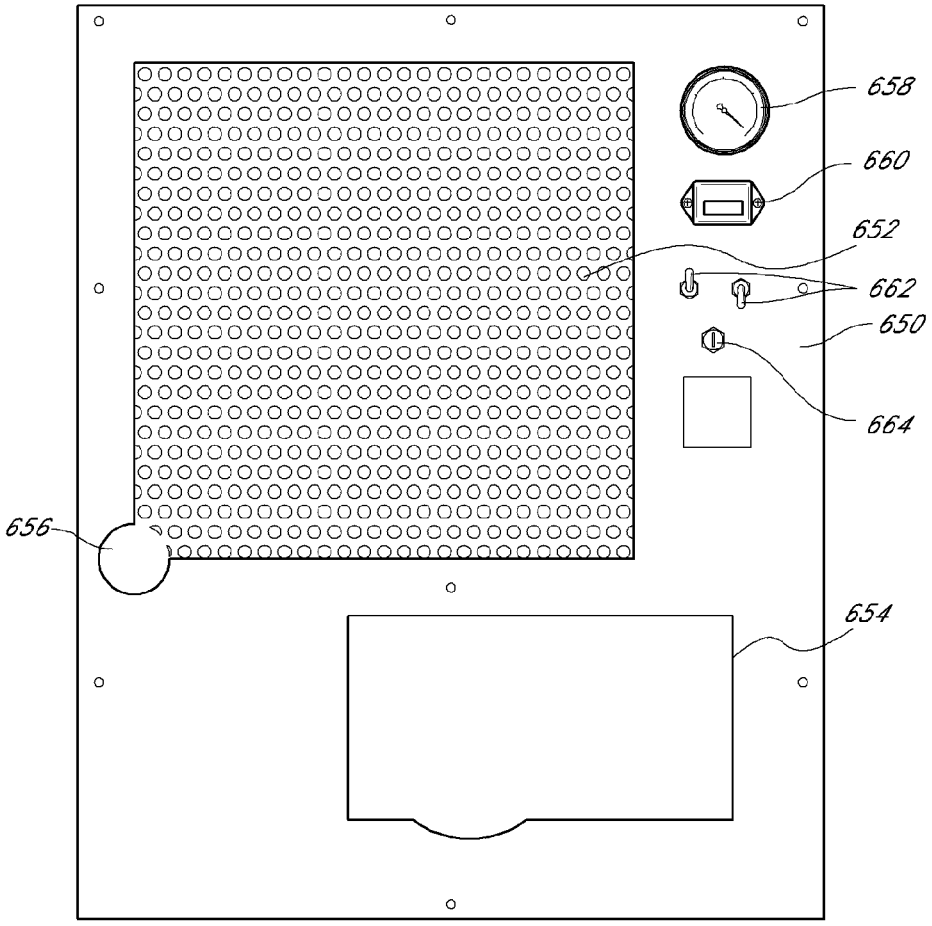
FIG. 37 is a front view is a front view of one embodiment of front console for a liquid removal system.

With reference to FIG. 37, a front console 650 for use in various embodiments of liquid removal system is illustrated. The front console 650 can be used in conjunction with an open sided housing as described above. The front console 650 can have a diffusion grate 652 to allow cooling air to reach the motor 20, but prevent debris from entering the liquid removal system. The front console 650 can have one or more apertures 654, 656, desirably sized and positioned to allow passage of the suction fittings, motor exhaust, and a liquid discharge outlet. An aperture 654 is desirably sized to allow removal of a front panel of a liquid extractor such that a user can quickly and easily access a liquid filter within the extractor without removing the front console 650 from the liquid removal system.

With continued reference to FIG. 37, the front console 650 can also include one or more gauges 658, 660 for monitoring system performance. For example, in some embodiments, the front console 650 can include a vacuum pressure gauge 658, indicating pressure inside the vacuum tank, and a tachometer 660, for measuring engine speed.

With reference to FIG. 37, the front console 650 can also include one or more user controls 662. In some embodiments, the user controls 662 are toggle switches. In some embodiments, one toggle switch is electrically coupled to the throttle of the motor with a solenoid. The throttle toggle switch and solenoid can be configured such that one position of the toggle switch causes the solenoid to maintain the throttle at an idle setting, and advancing the toggle switch to another position switch causes the solenoid to advance the throttle to an operational level. In some embodiments, a second toggle switch can be electrically coupled to a choke of the motor with a solenoid. With the choke toggle switch in a first position, the solenoid can position the choke in a cold start setting. With the choke toggle switch in a second position, the solenoid can position the choke in a warm operation setting. Thus, motor operation can be easily controlled by a user. In some embodiments, the operation of the motor can include a keyed activation requiring an operator to insert a key into a keyed switch 664 on the front console to start the motor for the liquid removal system.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. Further, the various features of these inventions can be used alone, or in combination with other features of these inventions other than as expressly described above. Thus, it is intended that the scope of the present inventions herein disclosed should not be limited by the particular disclosed embodiments described above, but should be determined only by a fair reading of the claims.

What is claimed is:

1. A system for transporting liquid, the system comprising:

a motor having an output shaft, the output shaft defining a longitudinal axis of the system;

a suction generation device, wherein the suction generation device comprises a centrifugal supercharger having an inlet and an outlet, wherein the inlet is fluidicly coupled to a vacuum tank and coupled to the motor such that operation of the motor drives the suction generation device;

a liquid intake port fluidicly coupled to the vacuum tank;

a liquid outlet port fluidicly communicating with the vacuum tank to draw liquid from the tank;

a discharge pump configured to transport liquid out of the liquid outlet port, the discharge pump coupled to the motor such that operation of the motor drives the discharge pump;

a clean water pump selectively coupled to the motor such that operation of the motor drives the clean water pump, the clean water pump fluidicly coupled to a clean water supply;

wherein the motor, the suction generation device, and the discharge pump are positioned such that the system is configured to fit inside a vehicle oriented such that the longitudinal axis is substantially aligned with a width of the vehicle;

wherein the suction generation device has a flow rate that is greater than a flow rate of the discharge pump when the motor is operating.

2. The system of claim 1, further comprising a silencer positioned under the motor and configured to receive an exhaust stream from the motor.

3. The system of claim 1, further comprising a housing configured to enclose the motor, the suction generation device, and the discharge pump.

4. The system of claim 3, further comprising a sealed gel battery.

5. The system of claim 3, wherein the housing has a reinforced upper deck unit configured to receive at least one piece of equipment.

6. The system of claim 1, wherein the motor is an internal combustion engine.

7. The system of claim 1, further comprising a liquid extractor positioned in fluid communication with the liquid intake port.

8. The system of claim 7, wherein said liquid extractor further comprises a removable liquid filter.

9. The system of claim 1, wherein the suction generation device has a lubrication system that is independent of the motor.

10. The system of claim 1, further comprising a sound muffling device, the sound muffling device configured to be coupled to the outlet of the suction generation device.

11. The system of claim 10, wherein the sound muffling device is configured to be coupled to the motor.

12. The system of claim 1, wherein the liquid intake port is positioned above a liquid discharge port on the vacuum tank.

13. A system for transporting liquid, the system comprising:

a rotatable shaft;

a vacuum tank;

a liquid intake port fluidicly connected to the vacuum tank;

a liquid outlet port configured such that the liquid intake port communicates with the liquid outlet port;

a liquid extractor in fluid communication with the liquid intake port;

a supercharger having an input shaft driven by the rotatable shaft, the supercharger being fluidicly coupled to the vacuum tank such that the supercharger creates vacuum in the vacuum tank and expels dynamically compressed gas to an exhaust system;

a discharge pump configured to transport liquid out of the liquid outlet port;

wherein the supercharger has a flow capacity that is greater than a flow capacity of the discharge pump.

14. The system of claim 13, further comprising a valve fluidicly coupled to the vacuum tank and having an open state in which air can flow through the valve into the vacuum tank and a closed state in which substantially no air can pass through the valve into the vacuum tank, wherein the valve is configured to enter the open state when a pressure in the vacuum tank reaches a preset level.

15. The system of claim 14, wherein the preset level is less than a collapse pressure of the vacuum tank.

16. The system of claim 13 further comprising an intake filter positioned within the vacuum tank.

17. The system of claim 13, wherein the liquid extractor is positioned in fluid communication with the liquid intake port such that liquid passes through the liquid extractor before entering the vacuum tank.

18. The system of claim 13, wherein the discharge pump is coupled to the rotatable shaft.

19. The system of claim 13, further comprising a clean water pump coupled to the rotatable shaft and being configured to be fluidicly coupled to a clean water supply.

20. The system of claim 13, wherein the exhaust system comprises a sound muffling device.

21. The system of claim 13, further comprising an internal combustion engine coupled to the rotatable shaft, wherein exhaust gases produced by the internal combustion engine are expelled to the exhaust system.

22. The system of claim 13, wherein the liquid intake port is positioned above a liquid discharge port on the vacuum tank.

23. A system for transporting liquid, the system comprising:

a motor having an output shaft, the output shaft defining a longitudinal axis of the system;

a suction generation device, wherein the suction generation device comprises a centrifugal having an inlet and an outlet, wherein the inlet is fluidicly coupled to a vacuum tank and coupled to the motor such that operation of the motor drives the suction generation device;

a liquid intake port fluidicly coupled to the vacuum tank;

a liquid outlet port fluidicly communicating with the vacuum tank to draw liquid from the tank;

a discharge pump configured to transport liquid out of the liquid outlet port, the discharge pump coupled to the motor such that operation of the motor drives the discharge pump;

a clean water pump selectively coupled to the motor such that operation of the motor drives the clean water pump, the clean water pump fluidicly coupled to a clean water supply;

wherein the motor, the suction generation device, and the discharge pump are positioned such that the system is configured to fit inside a vehicle oriented such that the longitudinal axis is substantially aligned with a width of the vehicle; and wherein the motor shares a lubrication system with the suction generation device such that motor oil is circulated from a crankcase of the motor to lubricate the suction generation device.

24. A system for transporting liquid, the system comprising:

a vacuum tank;

a supercharger fluidicly connected to the vacuum tank and configured to create vacuum in the vacuum tank, to dynamically compress gas, and to expel the gas to an exhaust system, wherein the supercharger is configured to be powered by a power take off from an operating power source;

a liquid intake port fluidicly connected to the vacuum tank;

a liquid outlet port fluidicly communicating with the vacuum tank to draw liquid from the tank;

a discharge pump configured to transport liquid out of the liquid outlet port;

a liquid extractor in fluid communication with the liquid intake port; and a valve fluidicly coupled to the vacuum tank and having an open state in which air can flow through the valve into the vacuum tank and a closed state in which substantially no air can pass through the valve into the vacuum tank, wherein the valve is configured to enter the open state when a pressure in the vacuum tank reaches a preset level;

wherein the supercharger has a flow capacity that is greater than a flow capacity of the discharge pump.

25. The system of claim 24 further comprising a clean water pump to provide one or both of clean water and a chemical solution to a cleaning attachment.

26. The system of claim 24, wherein the operating power source is an internal combustion engine.

27. The system of claim 26, wherein exhaust gases produced by the internal combustion engine are expelled to the exhaust system.

28. The system of claim 24, wherein the discharge pump is configured to be powered by a power take off from an operating power source.

29. The system of claim 24, wherein the liquid extractor further comprises a removable liquid filter.

30. The system of claim 24, wherein the exhaust system comprises a sound muffling device.

31. The system of claim 24, wherein the liquid intake port is positioned above a liquid discharge port on the vacuum tank.

* * * * *

UNITED STATES PATENT AND TRADEMARK OFFICE

CERTIFICATE OF CORRECTION

PATENT NO. : 8,814,533 B2
APPLICATION NO. : 13/033527
DATED : August 26, 2014
INVENTOR(S) : Mark Exner et al.

It is certified that error appears in the above-identified patent and that said Letters Patent is hereby corrected as shown below:

In the Specification

In column 13 at line 48, change “pick up” to --pickup--.

In the Claims

In column 19 at line 57, in Claim 23, change “centrifugal” to --centrifugal supercharger--.

Signed and Sealed this
Seventh Day of April, 2015

Michelle K. Lee

Michelle K. Lee
*Director of the United States Patent and Trademark Office*